US005537812A

United States Patent [19]

Rozenwasser

[11] Patent Number: 5,537,812

[45] **Date of Patent: *Jul. 23, 1996**

[54] FINE JEWELRY DIAMOND CUT CHAIN AND METHOD OF MANUFACTURE THEREOF

[75] Inventor: David Rozenwasser, Savion, Israel

[73] Assignee: Avraham Moshe Rozenwasser, Savion, Israel

[ * ] Notice: The term of this patent shall not extend beyond the expiration date of Pat. No. 5,412,935.

[21] Appl. No.: 239,350

[22] Filed: May 6, 1994

Related U.S. Application Data

[63] Continuation-in-part of Ser. No. 89,266, Jul. 9, 1993.

[30] Foreign Application Priority Data

May 31, 1993 [IL] Israel ..... 105850
Nov. 10, 1993 [IL] Israel ..... 107552

[51] Int. Cl.[6] ..... B21L 5/02

[52] U.S. Cl. ..... 59/80; 59/3; 59/35.1; 59/82

[58] Field of Search ..... 59/3, 35.1, 80, 59/82

[56] References Cited

U.S. PATENT DOCUMENTS

| | | | |
|---|---|---|---|
| 4,996,835 | 3/1991 | Rozenwasser | 59/80 |
| 5,185,995 | 2/1993 | Dal Monte | 59/80 |
| 5,285,625 | 2/1994 | Ofrat et al. | 59/80 |
| 5,408,820 | 4/1995 | Strobel et al. | 59/80 |
| 5,412,935 | 5/1995 | Rozenwasser | 59/80 |

*Primary Examiner*—David Jones
*Attorney, Agent, or Firm*—Helfgott & Karas

[57] ABSTRACT

A fine jewelry hollow rope chain comprising a plurality of interfitting hollow wire links, each link defining a circumference, each link having a wire cross-section defining a hollow base portion of generally uniform wall thickness and at least one reinforcing rib portion joined on said base portion, said rib portion protruding beyond said base portion along the entire circumference of said link, thereby reinforcing said hollow link against mechanical deformation, chain links for preparing such rope chains and a method of manufacturing same.

37 Claims, 21 Drawing Sheets

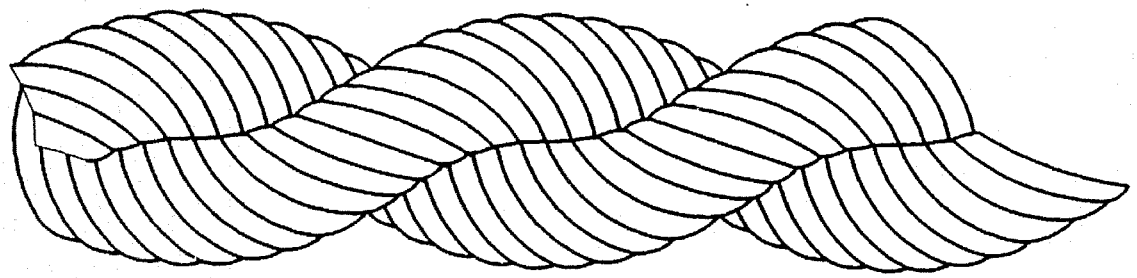
FIG.1A
PRIOR ART
FIG.1B
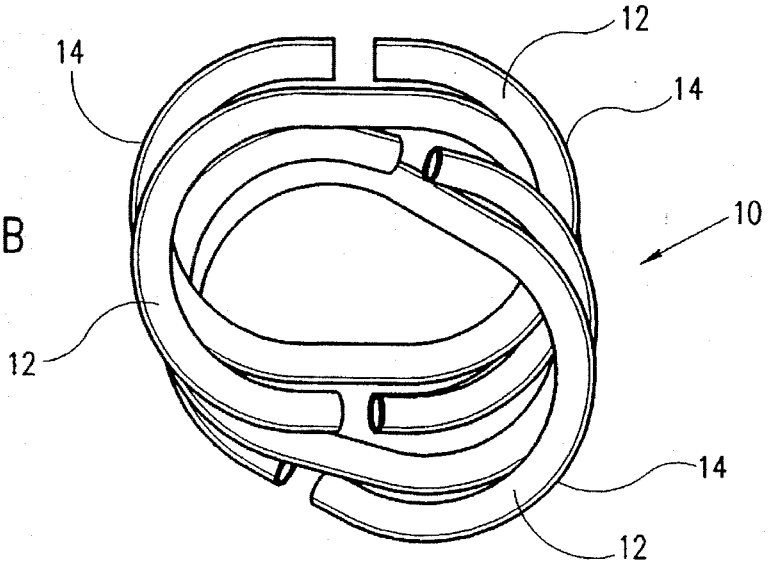
FIG.2A
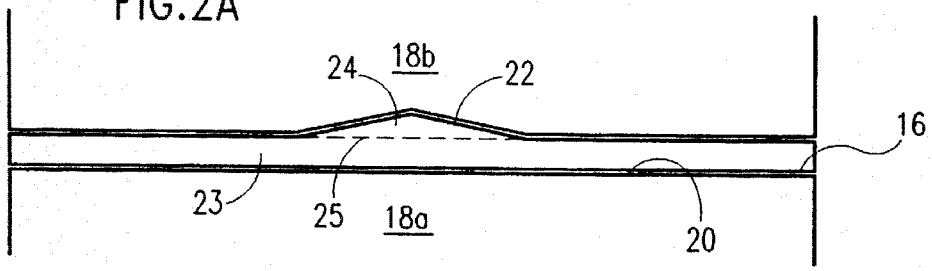

FINE JEWELRY DIAMOND CUT CHAIN AND METHOD OF MANUFACTURE THEREOF

This application is a continuation-in-part of application Ser. No.: 08/089,266 filed on Jul. 9, 1993 by inventor David Rosenwasser.

FIELD OF THE INVENTION

The present invention relates to fine jewelry diamond cut chains and to methods of manufacture thereof.

BACKGROUND OF THE INVENTION

Fine jewelry chains, in general, and fine jewelry rope chains, in particular, are well known. In U.S. Pat. Nos. 4,934,135 and 4,996,835, there are disclosed rope chains and methods for preparing such rope chains having reduced weight and labor costs compared with conventional rope chains of the same chain diameter. A rope chain of the prior art is illustrated in FIG. 1A.

In the field of rope chains there are known both solid rope chains and hollow rope chains. A solid rope chain is a rope chain whose links are made from solid portions of metal, while a hollow rope chain is a rope chain whose links are hollow. While the general appearance of a rope chain is not affected by the links thereof being either solid or hollow, the amount of precious metal used in a solid rope chain of a given size is significantly greater than the amount of precious metal used in a hollow rope chain of the same size. Accordingly, a hollow rope chain of a given size is significantly cheaper than a solid rope chain of the same size.

A particularly popular type of rope chain is a diamond cut rope chain. Such a chain comprises flat cuts or facets on the outer perimeter of at least some of the chain links to provide a chain with a high luster flat surface finish that reflects light and gives the chain a sparkle effect. Diamond cut facets are known to be formed on solid rope chains by cutting or shaving a flat facet from a curved section of the links.

Solid diamond cut rope chains have such flat facets generally cut about one third or more into the thickness of the chain link in order to obtain a reasonable size flat shiny surface. In this case, the amount of precious metal sheared away can be as much as 10% of the weight of the chain and although the metal shearings are collected and recycled, a significant amount of precious metal is nevertheless lost in the process.

Although it is known to form diamond cut facets on hollow rope chains, this presents certain problems due to the relative thinness of the outer wall of the hollow links used. In some cases the outer wall may be as thin as 0.05 mm. Accordingly, the forming of a facet in the way in which facets are formed on a solid rope chain would at least cause severe weakening of the outer wall of the link and would probably make a hole therein.

In U.S. Pat. No. 5,125,225 to Strobel, there is described the making of flat facet hollow rope chains. The method involves wrapping a hollow rope chain about a lathe drum, freezing the drum, applying water to the chain to freeze it in place thereby immobilizing it, and applying, by means of a burnishing tool, a plurality of incremental deformative thrusts of blunt force against some of the curved outer wall portions of the hollow links until this outer wall is deformed and pushed back towards the inner wall of the links, thus flattening portions of the curved outer wall.

The flattened portions of the outer walls are then diamond cut to remove or shave off a very thin layer of metal (about 0.001 to 0.002 mm) to provide smooth and shiny flat facets without making a hole in the link. The cross-section of the faceted area is deformed relative to the cross-section of the rest of the chain link.

A disadvantage of the above-described method to Strobel is that as only a very thin layer of metal is shaved from the flattened portions, any substantial dents introduced into the surface by the thrusts of the burnishing tool will remain even after diamond cutting of the facets. Accordingly, great control is required in the flattening of the portions whereat facets are to be formed.

While hollow rope chains have the advantage of being lightweight, and, therefore, less expensive than their solid counterparts, the strength of the individual links is considerably less than that of similar-sized solid links. It will also be appreciated that the cutting into the wall of a conventional hollow link causes yet further weakening of the link and, accordingly, of the chain.

SUMMARY OF THE INVENTION

The present invention seeks to provide an improved fine jewelry hollow rope chain which is stronger and thus more durable, than a similar-sized hollow rope chain of the prior art.

The present invention further seeks to provide an improved fine jewelry hollow rope chain which is stronger than a similar-sized hollow rope chain of the prior art, and onto which high luster surfaces may be formed without significantly weakening the chain.

There is thus provided, in accordance with an embodiment of the invention, a reinforced hollow chain link, having a wire cross-section comprising a hollow wire base portion of generally uniform wall thickness and a discrete rib section formed along a surface thereof beyond the base portion, said rib section extending along the entire perimeter of the chain link, reinforcing the link against mechanical deformation.

Additionally in accordance with an embodiment of the invention, the one or more ribs are demarcated from the base portion by a phantom demarcating surface.

Further in accordance with an embodiment of the invention, the one or more ribs are located so as to reinforce the link with respect to a force applied transversely to the rib portion.

Additionally in accordance with an embodiment of the invention, the link is a seamed link, and the seam and the rib portion lie along a common axis.

Further in accordance with an embodiment of the invention, the link is a seamed link, and the seam and the rib portion lie along mutually transverse axes.

Additionally in accordance with an embodiment of the invention, each hollow link defines an interior link surface and an exterior link surface parallel thereto, and the one or more ribs lie along the interior surface so as to protrude into the hollow interior of the link.

Further in accordance with an embodiment of the invention, each hollow link defines an interior link surface and an exterior link surface parallel thereto, and the one or more ribs lie along the exterior circumferential surface of the link.

Additionally in accordance with an embodiment of the invention, each hollow link defines an interior surface and an exterior surface parallel thereto, and the one or more ribs include one or more first ribs formed along the interior surface so as to protrude into the interior hollow space of the link and a second rib formed along the exterior circumferential surface of the link.

Further in accordance with an embodiment of the invention, each hollow link has one or more high luster surfaces formed thereon.

Additionally in accordance with an embodiment of the invention, the hollow link defines an interior surface and an exterior surface parallel thereto, and the one or more ribs lie along the interior surface so as to protrude into the interior of the link, and wherein the one or more high luster surfaces are formed on a portion of the exterior surface of the link corresponding to the location of the ribs.

There is also provided a fine jewelry rope chain manufactured from the reinforced link of the invention.

In accordance with a further embodiment of the invention, there is provided a method of manufacturing a fine jewelry rope chain including the following steps:

first, forming a length of metal foil having a base portion of generally uniform thickness and further having on the base portion thereof one or more reinforcing ribs;

second, forming the length of metal foil into a hollow wire having at least one reinforcing rib along its length;

third, forming the hollow wire into chain links, each having a gap slightly larger than the outer diameter of the link wire, so that one link can be fitted into another via the gap; and assembling the plurality of reinforced links into a reinforced rope chain.

Additionally in accordance with an embodiment of the invention, the first step of forming includes forming the rib on the base portion such that the rib portion is positioned to reinforce the link with respect to a force applied transversely to the rib portion.

Further in accordance with an embodiment of the invention, the second step of forming includes the step of forming a seamed hollow wire and the third step of forming includes the step of forming a seamed hollow link, and wherein the first step of forming includes the step of forming the rib on the base portion such that the seam and the rib portion lie along a common axis.

Additionally in accordance with an embodiment of the invention, the second step of forming includes the step of forming a seamed hollow wire and the third step of forming includes the step of forming a seamed hollow link, and wherein the first step of forming includes the step of forming the rib on the base portion such that the seam and the rib portion lie along mutually transverse axes.

Further in accordance with an embodiment of the invention, the second step includes folding the metal foil longitudinally about the rib such that the rib protrudes inwardly into the hollow space of the wire.

Additionally in accordance with an embodiment of the invention, the second step includes the step of folding the metal foil longitudinally such that the rib protrudes outwardly with respect to the wire.

Further in accordance with an embodiment of the invention, the first step of forming includes forming one or more pairs of ribs on opposite sides of the base portion, and the second step includes folding the metal foil longitudinally such that one rib protrudes outwardly with respect to the wire and one rib protrudes inwardly into the hollow space of the wire.

Additionally in accordance with an embodiment of the invention, the method also includes the step of providing one or more one high luster surfaces on the plurality of links.

BRIEF DESCRIPTION OF THE DRAWINGS

The present invention will be more fully understood and appreciated from the following detailed description, taken in conjunction with the drawings, in which:

FIG. 1A is a pictorial illustration of a portion of a fine jewelry rope chain of the prior art;

FIG. 1B is a magnified pictorial illustration of a portion of a rope chain manufactured in accordance with an embodiment of the present invention;

FIG. 2A is a schematic illustration of forming of link wire for use as a link in the rope chain of FIG. 1B;

DETAILED DESCRIPTION OF THE INVENTION

Reference is made to FIG. 1B, in which is illustrated, in enlarged schematic view, a representative portion, referenced generally 10, of a fine jewelry chain. While the chain is preferably a rope chain, it may alternatively be any other type of fine jewelry chain.

In accordance with the present invention, of which the aim is to provide a reinforced hollow chain, and particularly a rope chain, there is provided a plurality of reinforced hollow links 12, arranged in a repeating interlinking pattern, such as that shown in FIG. 1B, by way of example, made of a precious metal, such as gold. Preferably, although not necessarily, the links are also tightly interfitting.

The overall appearance of the resulting rope chain may be similar to the prior art chain, although the chain of the present invention is substantially lighter than a prior art solid rope chain of the same external dimensions, and is stronger than a similar-sized prior art hollow rope chain.

It is intended that an entire rope chain of preferably tightly interfitting links be represented by the plurality of links illustrated in FIG. 1B.

In accordance with one embodiment of the invention, the links 12 may have formed thereon one or more diamond cut high luster surfaces 14. It will thus be appreciated that, not only does the present invention provide links that are stronger than their prior art counterparts, but it also provides for the formation thereon of high luster surfaces while retaining a strength similar to or, in many cases, greater than that of prior art hollow links.

Referring now to FIGS. 2A–4, there are illustrated various stages in the manufacture of links 12 from a strip of precious metal foil, formed typically of an alloy of gold, silver or platinum.

Figure 2B:
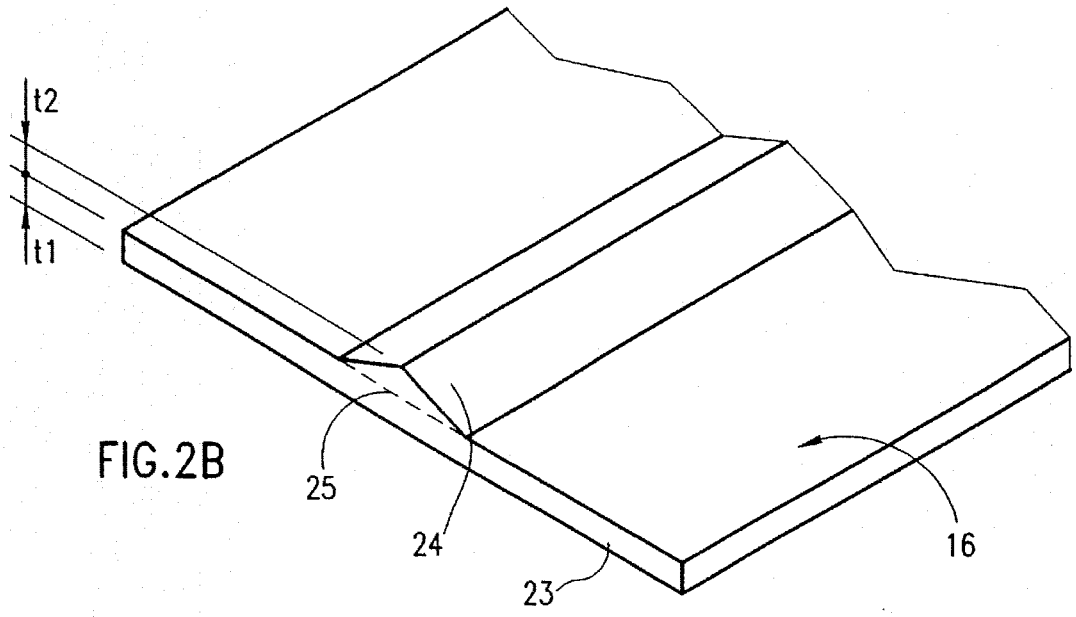
FIG. 2B is a schematic illustration of a portion of the link wire formed as shown in FIG. 2A, having a reinforcing rib in accordance with an embodiment of the present invention.

As seen in FIG. 2A, a precious metal foil 16 is fed through a rolling mill comprising first and second mill members referenced 18*a* and 18*b*, respectively. In the present example, mill member 18*a* has a planar milling surface 20, while the other mill member 18*b* has a groove formed therein. The groove, denoted by reference numeral 22, is provided so as to impart a raised portion or "rib" 24 to the foil 16 of precious metal as it emerges from the rolling mill. Accordingly, the resulting milled foil 16 has a generally rectangular 'base' portion 23 (FIG. 2B) of uniform cross-sectional thickness t1, and rib 24 which has an additional thickness t2. Base portion 23 and rib 24 are illustrated diagrammatically as being "separated" by a phantom demarcation surface, referenced 25. As foil 16 is a single continuum of metal, surface 25 is imaginary only, and is provided solely to demonstrate the protrusion of rib 24 relative to the uniform thickness base portion 23.

As will be appreciated from the description of FIGS. 2A–2D, the groove 22 and, similarly, rib 24 may have any of a large variety of configurations and may be provided at any preferred location on the foil surface 16, depending on the preferred position thereof on a link formed in accordance with the present invention. Preferably, the thickness of rib 24 is sufficient not only to reinforce the link of the present invention relative to a counterpart prior art link, but also so as to permit formation therein of one or more high luster surfaces of preselected sizes and configurations, without substantially reducing the additional strength provided by rib 24.

Figure 2C:
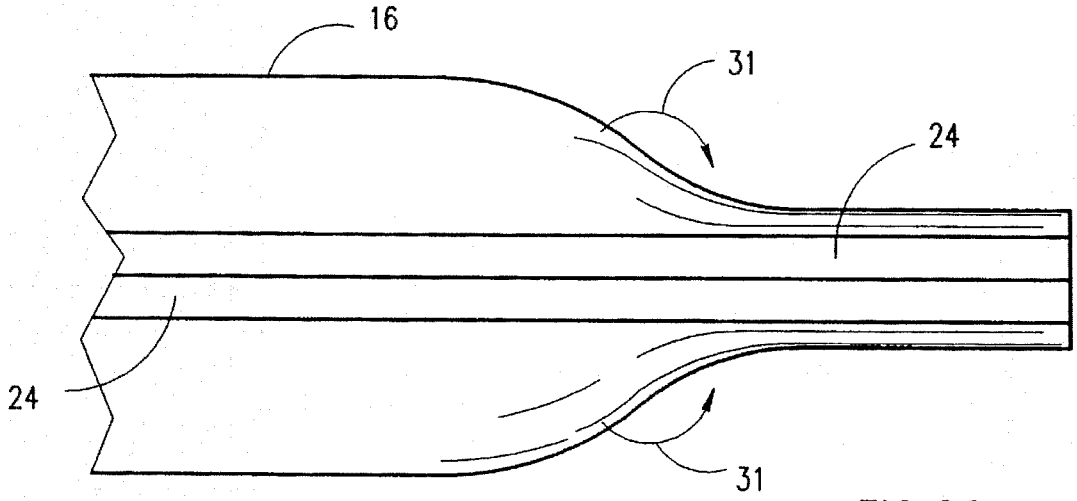
FIG. 2C is a schematic illustration of the outward folding of the link wire so as to form a tube, such that the reinforcing rib extends in a generally outward direction relative to the tube.
Figure 2D:
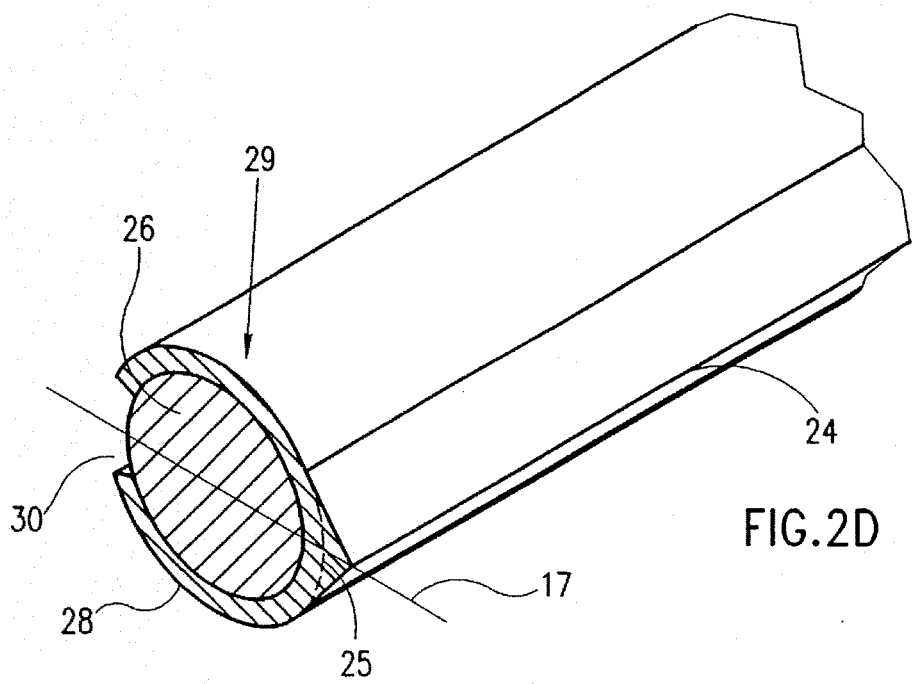
FIG. 2D is a schematic illustration of a cylindrical tube formed by folding the link wire of FIG. 2B about its longitudinal axis, as shown in FIG. 2C.

Referring now also to FIG. 2C and 2D, after the ribbed metal foil 16 has been formed as described, it is then drawn through a die (not shown) together with a soft metal wire core 26, to produce a precious metal wire 28 (FIG. 2D) with an outer envelope 29 having an elongate rib 24 which protrudes beyond phantom demarcation surface 25. Typically, the die is round, such that the link wire produced has a similarly round cross-sectional configuration.

Alternatively, however, link wire may be produced having any geometric cross-section, depending on the shape of the orifice in the die through which it is drawn such shapes may be round, oval, barrel shaped, triangular, square, rectangular, diamond shaped, hexagonal, octagonal, symmetrical, elongated or irregular. Various different cross-sectional configurations of hollow wire are shown in FIGS. 14A–30B below. Notwithstanding the variety of configurations of hollow wire into which the metal foil can be shaped, the base portion 23 thereof will have substantially the same wall thickness throughout.

The width of the wire 16 is generally 15–20% smaller than the circumference of the soft metal core 26, thereby producing a gap or "seam" 30 (FIG. 2D) in the precious metal envelope or tube 28 covering the core 26. The purpose of seam 30 is to provide a sufficiently large surface area for acid to come in contact with the soft metal core 26 and dissolve it, such that metal envelope 28 remains, constituting a hollow wire.

Referring again to FIG. 2C, it is seen that, in order to produce the described hollow wire wherein rib 24 faces outward (as seen in FIG. 2D), the metal foil 16 is folded away from the rib 24. This is indicated by arrows 31. Conversely, if it is sought to form a hollow wire wherein the rib 24 faces the interior of the wire, it is folded towards the rib 24. This is shown and described below in conjunction with FIG. 10A.

In the present embodiment, as rib 24 is positioned along the longitudinal axis of symmetry of metal foil 16 (FIG. 2B), the seam 30 is formed diametrically opposite to the rib. This is demonstrated by illustration of a diametrical axis 17 in FIG. 2D.

Figure 2E:
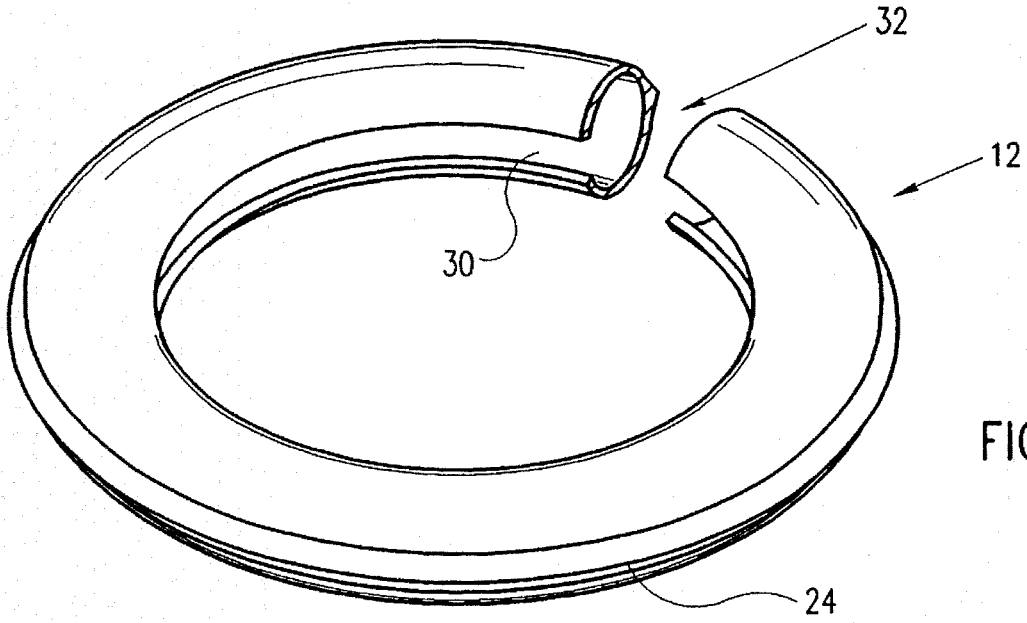
FIG. 2E is a schematic illustration of a reinforced link formed from the tube shown in FIG. 2D.

Chain links 12, as shown in FIG. 2E, are prepared from wire 29 in a conventional manner by winding the wire into a coil and cutting it before each complete turn, thereby forming a helical link with a gap 32. The link is then slightly flattened so as to become unskewed, as shown in FIG. 2E, ready for assembly with other similar links into a rope chain. The gap 32 is slightly larger than the outer diameter of the link 12, so that one link can be fitted into another via the gap 32. The links, or preferably the chain made of such links, are then immersed in a suitable acid to dissolve the soft metal core 18 leaving hollow reinforced links 12.

It will be appreciated by persons skilled in the art that the provision of rib 24 causes the reinforced links 12 of the present invention to be stronger than their counterpart links of the prior art. Accordingly, reinforcement of links 12 in this manner produces a correspondingly reinforced rope chain which, while retaining the overall external configuration of a rope chain (such as shown in FIG. 1A), is stronger and therefore more durable than non-reinforced prior art chains.

It will further be appreciated that the reinforcement of links 12 of the present invention may be provided not only by reinforcing ribs such as that shown and described above in conjunction with FIGS. 2A–2E, but also by reinforcing ribs having any suitable configuration, position or orientation such as those described hereinbelow in conjunction with FIGS. 10B–30B.

Figure 3:
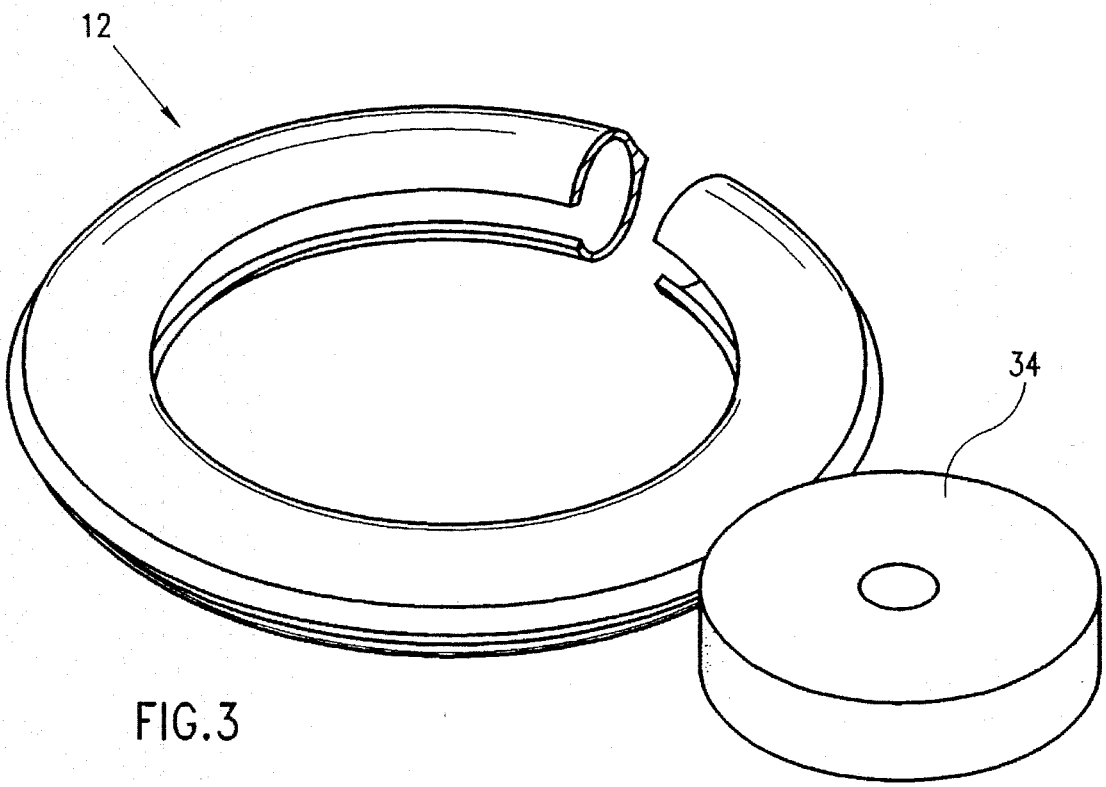
FIG. 3 is a schematic illustration of the forming of high luster surfaces on the reinforced link of FIG. 2E.
Figure 4:
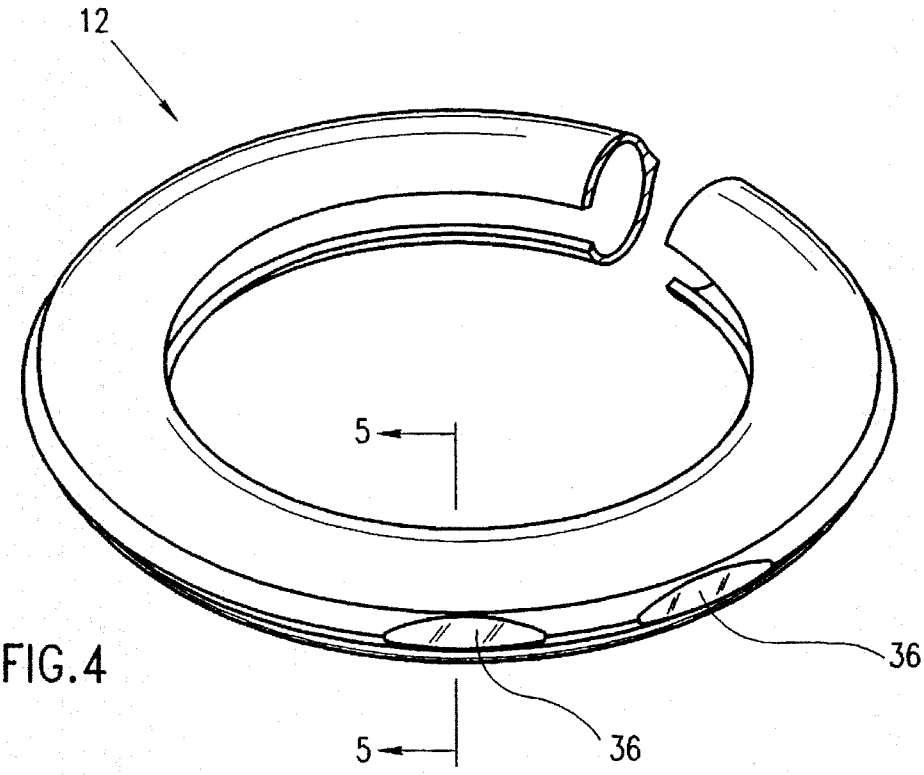
FIG. 4 is a schematic illustration of the reinforced link of FIG. 2E having two diamond cut high luster surfaces formed thereon by the method of FIG. 3.

Referring now to FIGS. 3 and 4, in accordance with an embodiment of the invention, one or more high luster surfaces 36 (FIG. 4) may be provided by use of a diamond cutting tool, shown schematically at 34 (FIG. 3).

Figure 5:
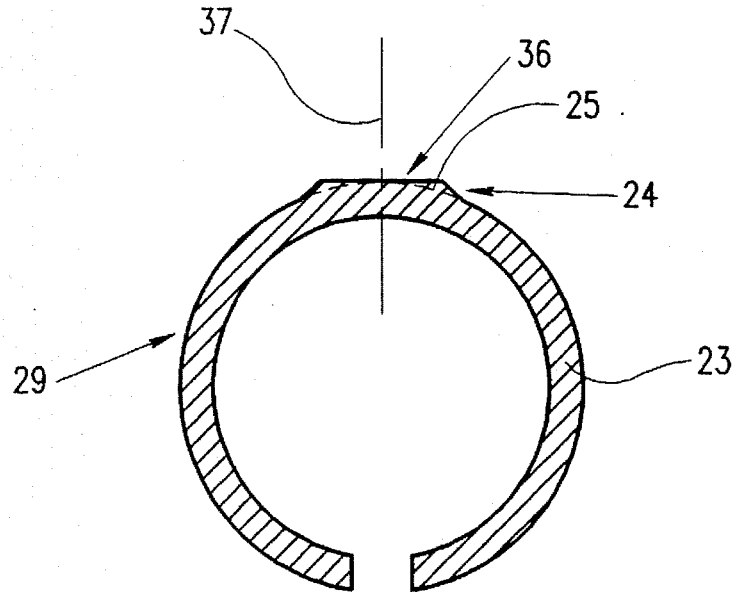
FIG. 5 is a cross-sectional representation of the reinforced link of FIG. 4 taken along line 5—5 thereon.

As seen in FIG. 5, it is seen that high luster surface 36 is formed by cutting exclusively into the rib 24 only, and that the base portion 23 of the link remains virtually intact. This is demonstrated by the phantom demarcation surface 25 which indicates a circular continuation of the outward-facing surface 29 of the base portion 23.

It will thus be apparent that the wall thickness of the hollow link 12 varies, in the present example, between a. a thickness that does not differ substantially from the thickness of the base portion 23 at a central portion of a high-luster surface 36, taken along a center line 37 (FIG. 5) thereof, and b. a thickness equal to the sum of the thickness of base portion 23 and the maximum thickness of the rib 24, i.e. at a location where the raised portion is uncut.

Figure 6:
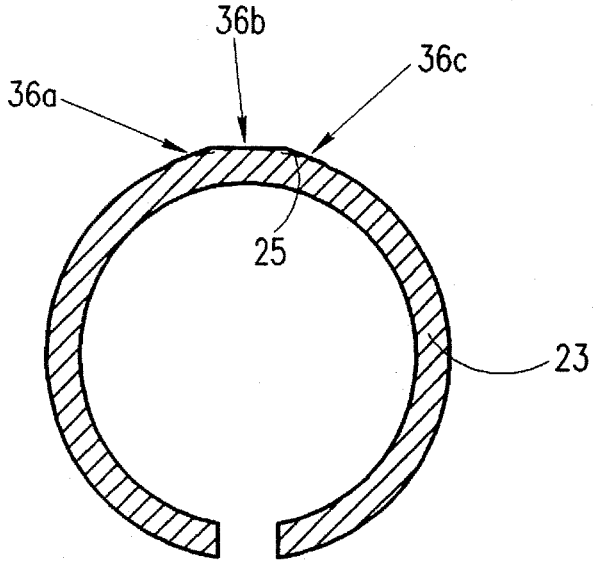
FIG. 6 is a cross-sectional representation of a reinforced link formed in accordance with an alternative embodiment of the invention.

Referring now also briefly to FIG. 6, it is seen that a plurality of high luster surfaces, referenced 36*a*, 36*b* and 36*c* may alternatively be provided by cutting into rib 24 of link 12. Each of surfaces 36*a*–36*c* is tangential to or parallel to a tangent of the outward-facing surface 29 of the base portion 23, and the overall effect of the provision of the plurality of surfaces is to provide a larger high luster surface area than that produced by provision of merely a single high luster surface.

It will be appreciated that the formation of high luster surfaces 36 in the present embodiment requires cutting into the rib 24 only. Accordingly, although rib 24 has been almost completely cut away, thereby removing any significant reinforcement of the link 12 that would have been provided by the rib, the resulting cut link retains at least the same strength of an equivalent prior art hollow link, and also provides one or more high luster surfaces. Formation of high luster surfaces in this manner, therefore, does not require precautions to be taken to prevent weakening of the wire wall during diamond cutting thereof.

It should be noted, however, that the examples of FIGS. 5 and 6 are demonstrative of one aspect of the invention when carried to an extreme, and preferably, the formation of high luster surfaces should require only partial cutting away of the reinforcing rib 24 of link 12, thereby providing a high quality sparkling effect in a reinforced, stronger and more durable hollow rope chain.

The above-described method of manufacture of a fine jewelry chain described hereinabove in conjunction with FIGS. 3A–4 involves diamond forming high luster surfaces 36 (FIGS. 3 and 4) on individual links 12, prior to assembly thereof into a chain 10.

In accordance with an alternative embodiment of the invention, a plurality of links of the invention is assembled into a chain prior to the diamond forming of high luster surfaces thereon.

Figure 7:
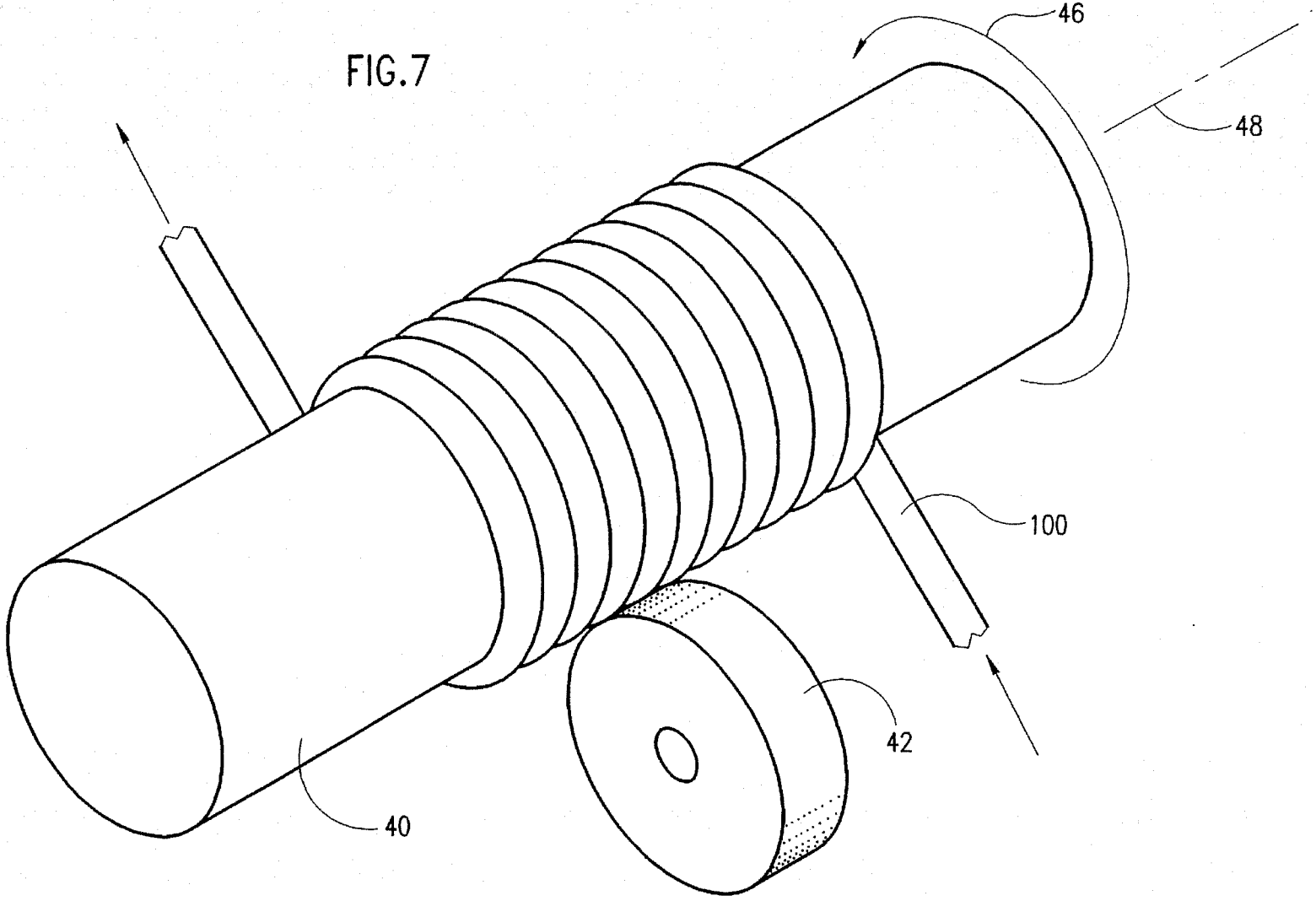
FIG. 7 is a schematic illustration of diamond cutting of an assembled rope chain in accordance with an alternative embodiment of the present invention.

Referring now to FIG. 7, there is shown an assembled uncut chain 100 (shown schematically) which is wound around a support 40. A diamond cutting tool is shown schematically at 42. As indicated by arrow 46, support 40 is rotated about an axis 48, thereby to cause a corresponding feeding of chain 100 thereabout, in engagement with tool 42. As chain 100 is fed past tool 42, a predetermined portion of an outward-facing surface of the chain is brought into diamond cutting engagement with the tool 42, such that ribs 24 (FIGS. 2E–5) have high luster surfaces formed thereon, substantially as shown at 36 in FIGS. 4, 5 and 6.

Figure 8A:
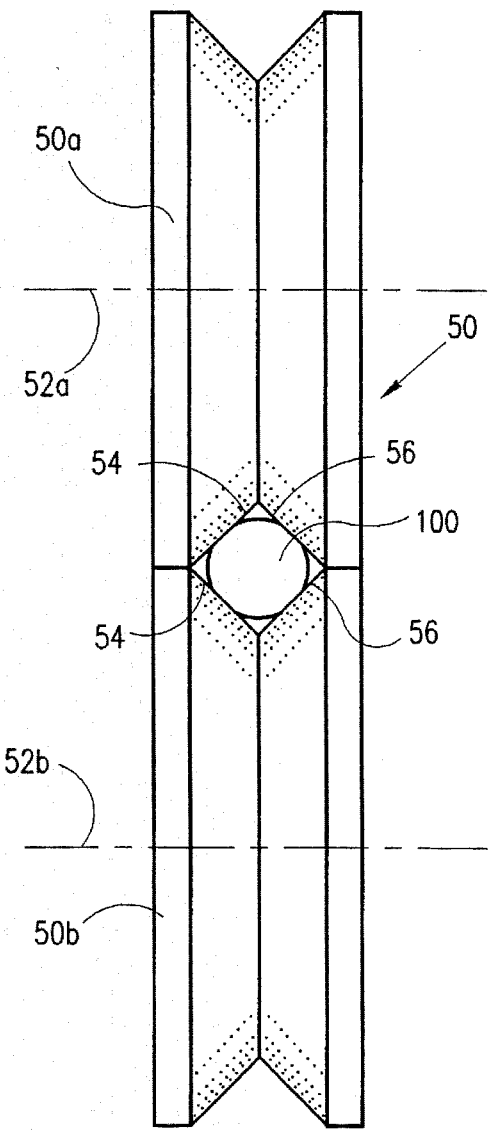
FIGS. 8A and 8B are schematic illustrations of diamond cutting of an assembled jewelry chain in accordance with further embodiments of the present invention.
Figure 8B:
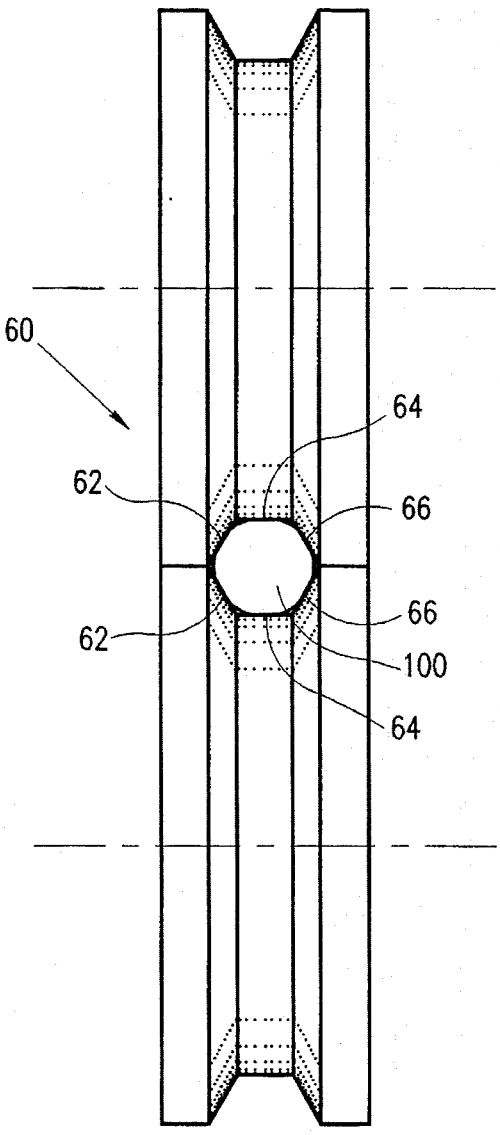

Reference is now made to FIGS. 8A and 8B, in which are shown diamond grinding wheels, respectively referenced 50 and 60, operative to provide high luster surfaces 36 (FIGS. 4, 5 and 6) to chain 100, in accordance with yet further embodiments of the invention.

Figure 9A:
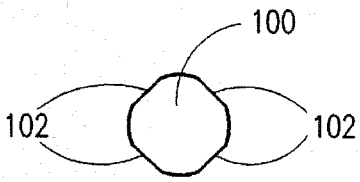
FIGS. 9A and 9B are schematic end views of jewelry chains after having been diamond cut in accordance with the methods of FIGS. 8A and 8B respectively.

In FIG. 8A, there is illustrated a pair of grinding wheels **50*a* and 50*b*, adapted for rotation about respective axes 52*a* and 52*b*. As seen in the drawings, the wheels 50*a* and 50*b* are arranged to take up an uncut chain 100 fed therebetween and so as to impart thereto a plurality of high luster surfaces 36 (FIGS. 4, 5 and 6) on a predetermined number of chain facets 102. In the illustrated embodiment, each grinding wheel has a pair of grinding surfaces 54 and 56 arranged in a V configuration. Accordingly, as seen schematically in FIG. 9A, chain 100 has circular, four chain facets 102** arranged in a square-like configuration.

Figure 9B:
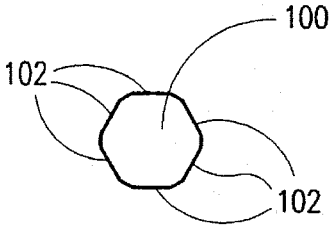

The apparatus illustrated in FIG. 8B is similar to that of FIG. 8A and is thus not described in detail herein, except for its differences. As seen, each grinding wheel **60*a* and 60*b* has three grinding surfaces 62, 64 and 66, thereby to impart a quasi-hexagonal configuration to chain 100 when viewed from the end. This is illustrated in FIG. 9B**.

Figure 10A:
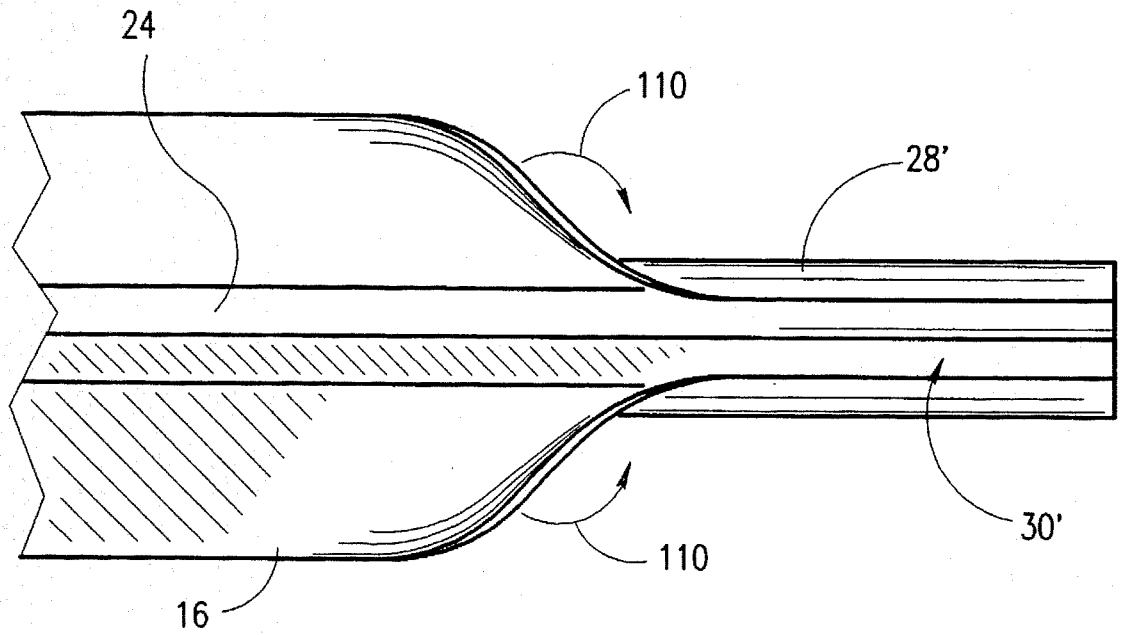
FIG. 10A is a schematic illustration of the inward folding of the link wire of FIG. 2B so as to form a tube wherein the reinforcing rib extends in a generally inward direction relative to the tube.

Referring now to FIG. 10A, in accordance with a further preferred embodiment of the invention, metal foil 16 (also seen in FIG. 2B) may be folded inwardly, as indicated by arrows 110, such that rib 24 becomes positioned inwardly of the resulting hollow wire 28'. The resulting seam extending along the length of the wire 28' is indicated by reference numeral 30'.

Figure 10B:
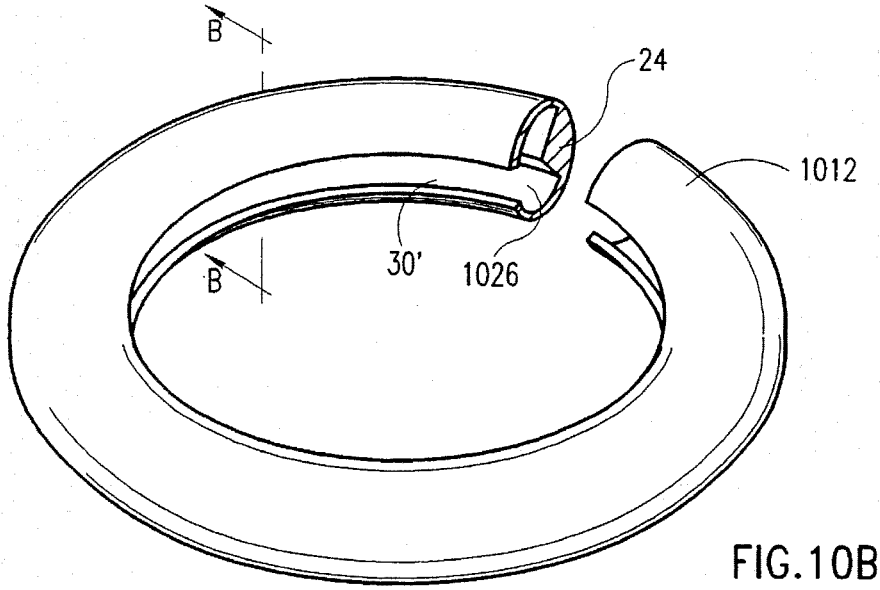
FIG. 10B is a schematic view of a reinforced circular-section link formed from the tube of FIG. 10A.
Figure 10C:
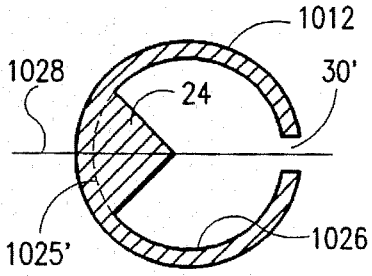
FIG. 10C is a cross-sectional view of the link of FIG. 10B, taken along line B—B therein, illustrating the rib and a seam of the link as having mutually opposite orientations.

Referring now to FIGS. 10B and 10C, the tube 28' is formed into a reinforced link 1012, wherein, as described in conjunction with FIG. 10A, an elongate reinforcing rib 24 extends inwardly, beyond inner phantom demarcation surface 1025', along an interior surface 1026 of the link diametrically to seam 30', such that rib 24 and seam 30' lie along a common diametric axis 1028 (FIG. **10*c***).

Figure 10E:
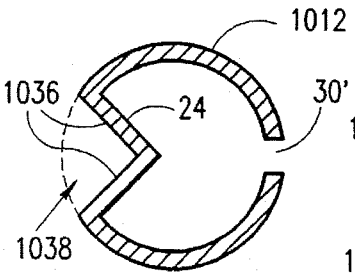
FIGS. 10D and 10E are respective perspective and sectional views of the reinforced link of FIG. 10B, after the formation thereon of high luster surfaces, in a notch configuration.
Figure 10F:
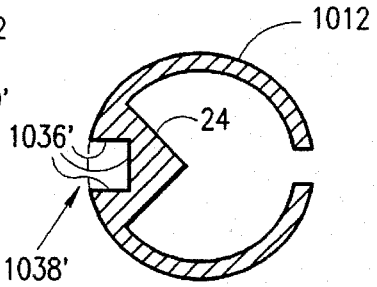
FIG. 10F is a sectional illustration of the reinforced link of FIG. 10B after the formation thereon of high luster surfaces in an alternative notch configuration.
Figure 10D:
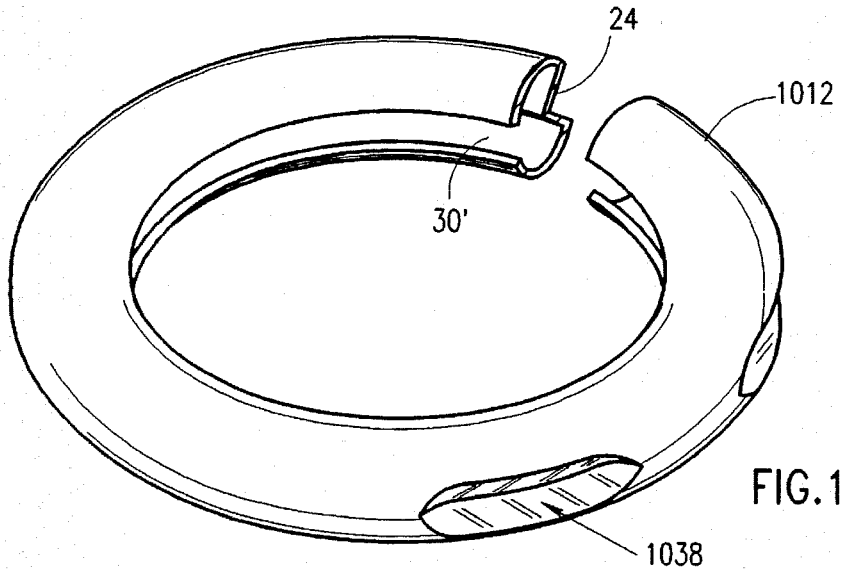

FIGS. 10D and 10E are respective perspective and sectional views of the reinforced link 1012 of FIG. 10B, after the formation thereon of high luster surfaces 1036, in a V-notch configuration, indicated generally by reference numeral 1038.

FIG. 10F is a sectional illustration of the reinforced link 1012 of FIG. 10B after the formation thereon of high luster surfaces 1036' in a square- or rectangular-shaped notch configuration 1038'.

It will be appreciated by persons skilled in the art that, while a reinforced fine jewelry rope chain in accordance with the present invention may not be as strong its solid counterpart, it is necessarily stronger than the non-reinforced hollow rope chain of the prior art.

Figure 11A:
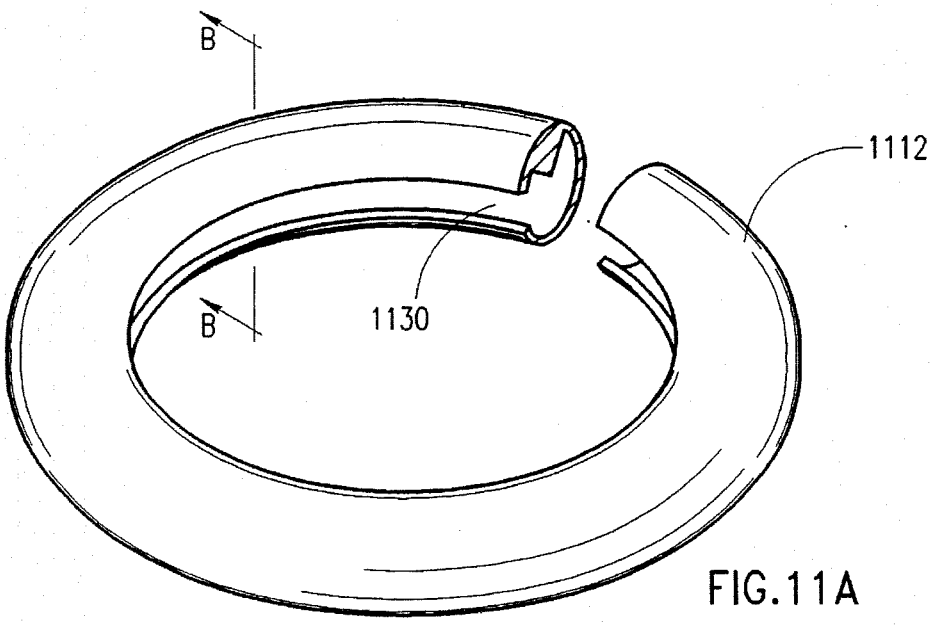
FIGS. 11A and 11B are respective perspective schematic and sectional views of a reinforced circular-section link, similar to that of FIGS. 10B and 10C, but wherein the rib and the seam have mutually transverse orientations.
Figure 11B:
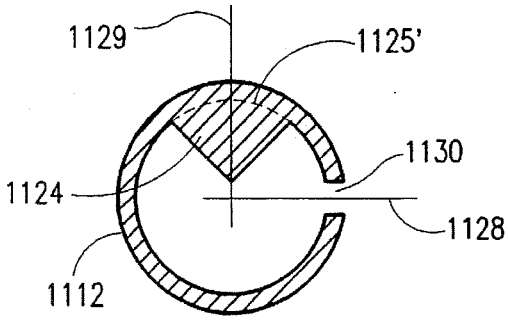

Referring now to FIGS. 11A and 11B, there is shown a reinforced round link 1112 of generally uniform wall thickness, similar to that of FIGS. 10B and 10C, but wherein the seam 1130 and the rib 1124 extend along mutually transverse diametric axes, respectively referenced 1128 and 1129. Rib 1129 is seen to protrude inwardly, beyond inner phantom demarcation surface 1125'.

Figure 12A:
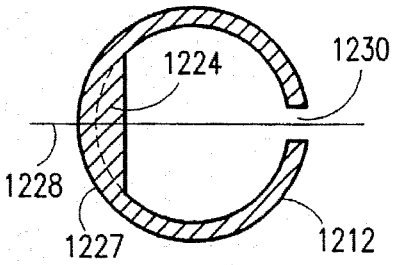
FIG. 12A is a sectional view of a reinforced circular-section link having a flattened reinforcing rib formed internally thereof, opposite the link seam.

Referring now to FIG. 12A, there is shown a reinforced hollow link 1212 having generally round cross-sectional uniform wall thickness with a flattened reinforcing rib 1224 extending inwardly, beyond inner phantom demarcation surface 1225', opposite the link seam 1230. A diametric axis, common to both rib 1224 and seam 1230 is indicated by reference numeral 1228.

Figure 12B:
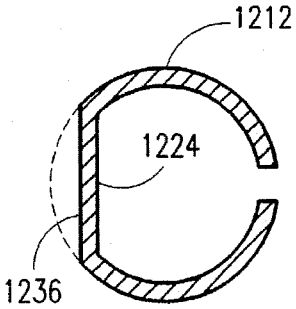
FIGS. 12B and 12C are sectional illustrations corresponding to that of FIG. 12A, but wherein one or more high luster surfaces have been cut into the exterior of the link in locations corresponding to that of the rib.
Figure 12C:
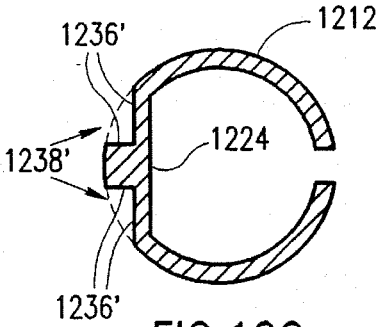

Referring now also to FIGS. 12B and 12C, there are illustrated alternative configurations of links 1212 having high luster surfaces 1236 and 1236' respectively, formed on portions of the exterior surface 1227 of link 1212 corresponding to the location of rib 1224. In FIG. 12B, a single high luster surface 1236 is illustrated. In FIG. 12C however, two pairs of high luster surfaces 1236' are illustrated, each pair defining a right-angled notch 1238.

Figure 13A:
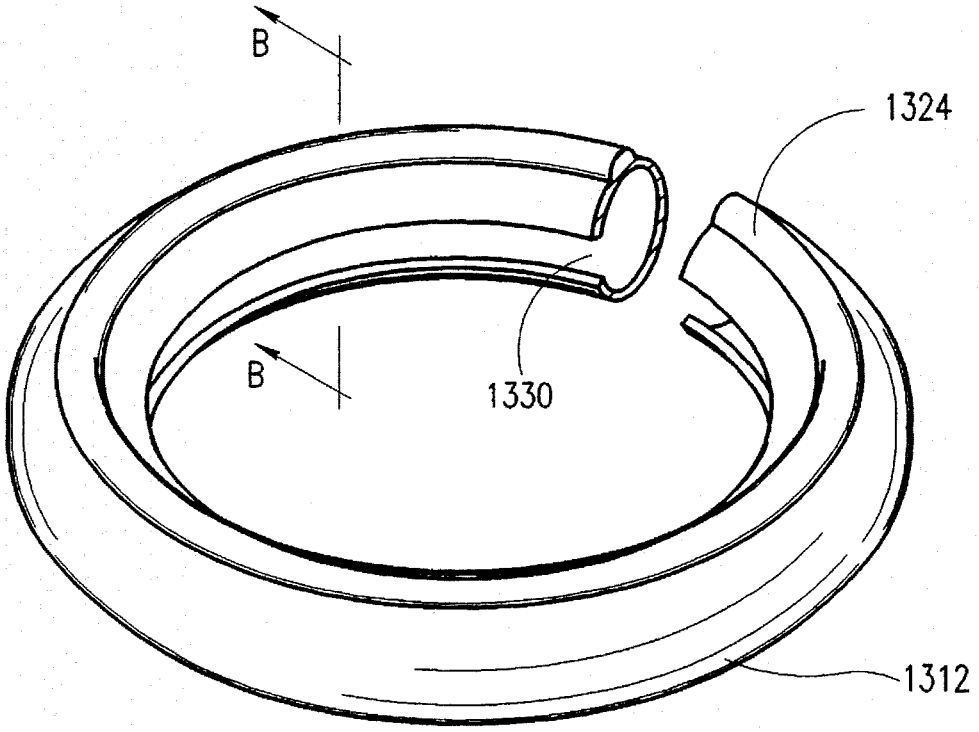
FIGS. 13A and 13B are respective perspective schematic and sectional views of a reinforced circular-section link, having an external reinforcing rib oriented transversely to the link seam.
Figure 13B:
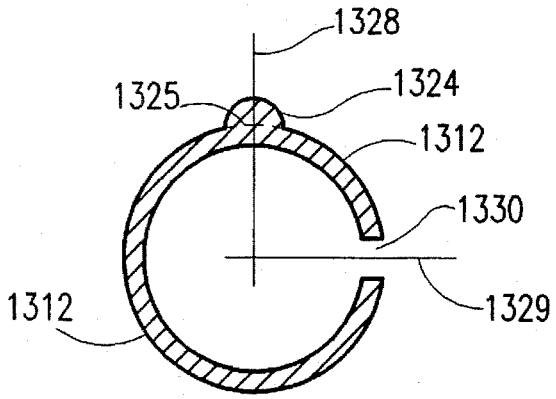

With reference to FIGS. 13A and 13B, there is illustrated, in perspective and cross-section respectively, a reinforced round link 1312 of generally uniform wall thickness and having a reinforcing rib 1324 extending outwardly, beyond outer phantom demarcation surface 1325, and oriented transversely to the link seam 1330. Seam 1230 and rib 1224 are seen to extend along mutually transverse axes, referenced 1328 and 1329, respectively.

Figure 14A:
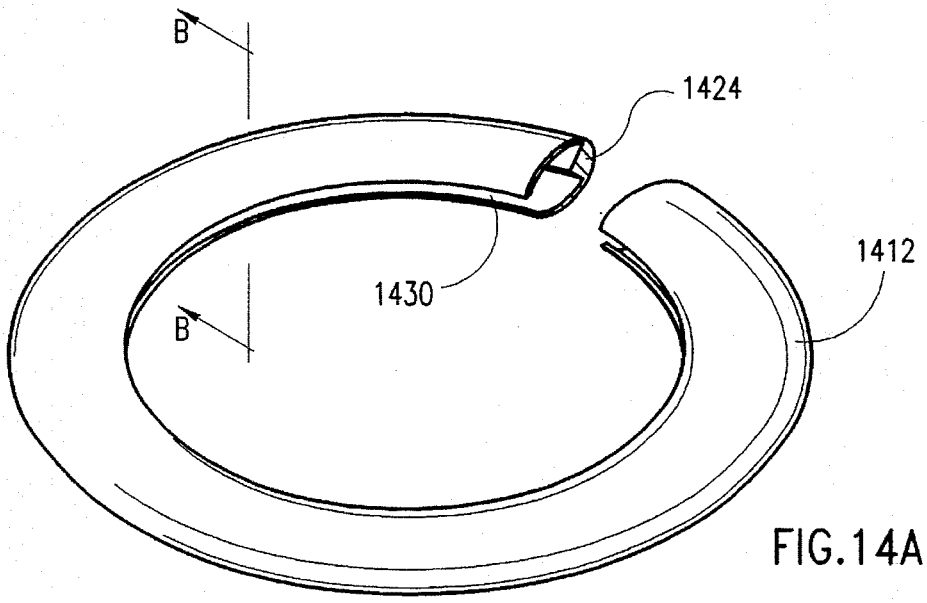
FIG. 14A is a perspective view of a reinforced elliptical-section link having a reinforcing rib formed internally thereof, opposite the link seam, along the major axis.
Figure 14B:
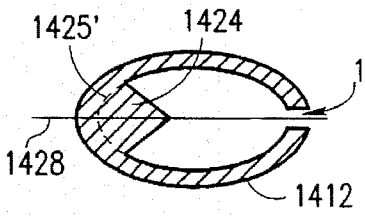
FIG. 14B is a cross-sectional view of the link of FIG. 14A, taken along line B—B therein, illustrating the rib and a seam of the link as having mutually opposite orientations.

Referring now to FIGS. 14A and 14B, there is illustrated a reinforced round link 1412 having an elliptical cross-section of generally uniform wall thickness and having a reinforcing rib 1424 extending inwardly of the link 1412, beyond inner phantom demarcation surface 1425' (FIG. 14B). Rib 1424 is formed opposite the link seam 1430, such that both seam 1430 and rib 1424 lie along the major axis 1428 of the elliptical section as seen in FIG. 14B.

Figure 14D:
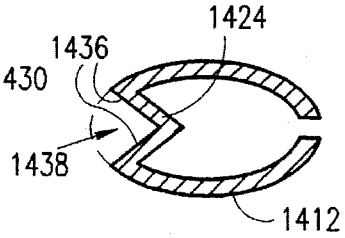
FIGS. 14C and 14D are respective perspective and sectional views of the reinforced link of FIG. 14A, after the formation thereon of high luster surfaces, in a notch configuration.
Figure 14E:
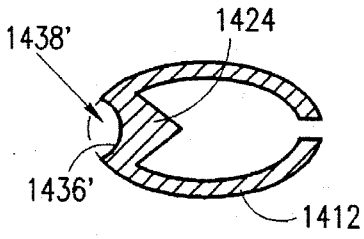
FIG. 14E is a sectional illustration of the reinforced link of FIG. 14A after the formation thereon of a high luster surface in a curved recess configuration.
Figure 14C:
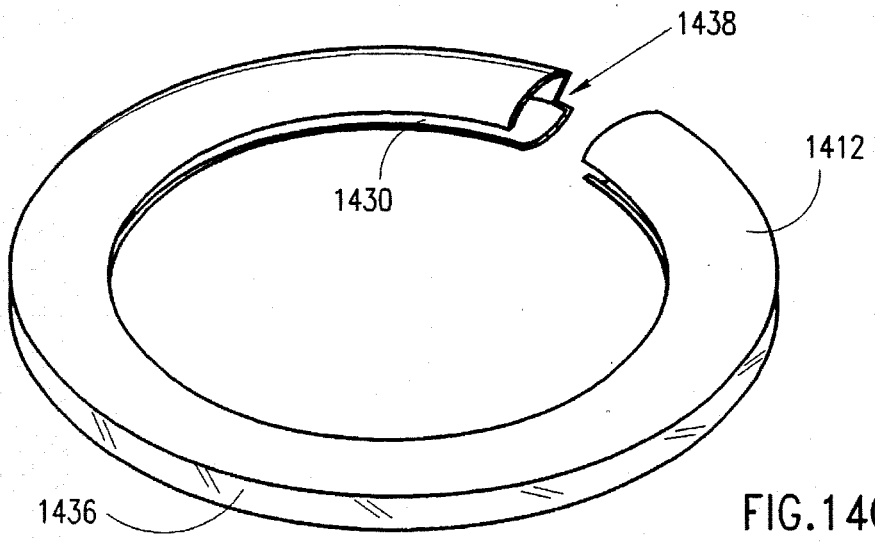

Referring now to FIGS. 14C and 14D, there are shown respective perspective and sectional views of the reinforced link 1412 of FIG. 14A, after the formation thereon of high luster surfaces 1436, in a V-notch configuration 1438.

FIG. 14E is a cross-sectional view of the reinforced link wire 1412 of FIG. 14A after the formation thereon of a high luster surface 1436' in a curved recess configuration, indicated by reference numeral 1438'.

Figure 15A:
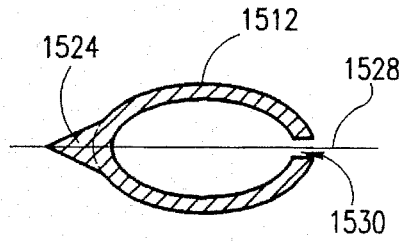
FIGS. 15A and 15B are sectional illustrations of a reinforced link similar to that of FIGS. 14A and 14B, but wherein the rib extends outwardly from the link, prior to and after formation of a high luster surface thereon, respectively.
Figure 15B:
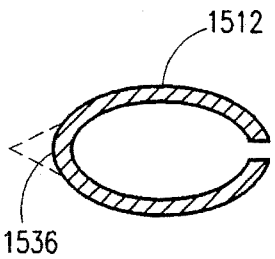

Referring now to FIGS. 15A and 15B, there are shown cross-sectional illustrations of a reinforced link wire 1512 similar to that of FIGS. 14A and 14B, but wherein a reinforcing rib 1524 extends outwardly from the link 1512, beyond outer phantom demarcation surface 1525. The rib 1524 and seam 1530 are shown to lie along the major axis 1528 of the elliptical section. FIG. 15A shows link 1512 wherein the rib 1524 is intact, whereas FIG. 15B shows the link 1512 after formation thereon of a high luster surface 1536.

Figure 15C:
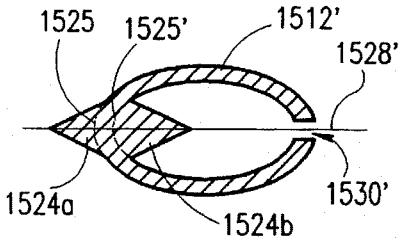
FIG. 15C is a sectional illustration of a reinforced elliptical-section link having a pair of opposing internal and external reinforcing ribs formed in alignment with the link seam, along the major axis.

FIG. 15C is a sectional illustration of a reinforced elliptical cross-section link wire 1512' having a pair of opposing external and internal reinforcing ribs, respectively referenced 1524*a* and 1524*b*, extending beyond outer and inner phantom demarcation surfaces 1725 and 1725', formed in alignment with link seam 1530' along major axis 1528'.

Figure 16A:
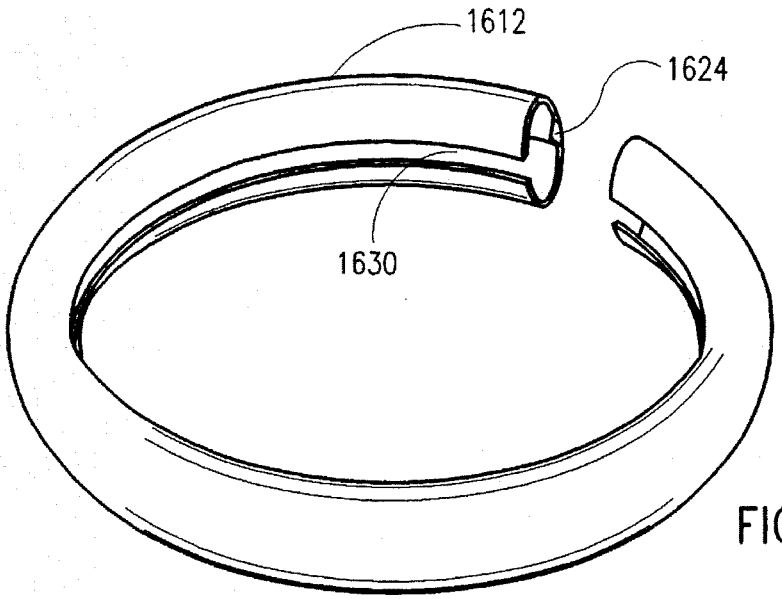
FIG. 16A is a perspective view of a reinforced elliptical-section link having a reinforcing rib formed internally thereof, opposite the link seam, along the minor axis of the link cross-section.
Figure 16B:
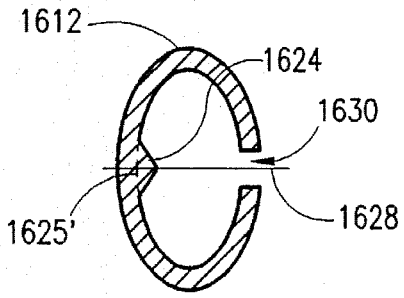
FIG. 16B is a cross-sectional view of the link of FIG. 16A, taken along line B—B therein, illustrating the rib and a seam of the link as having mutually opposite orientations.

Referring now to FIGS. 16A and 16B, there is illustrated a reinforced link 1612 having an elliptical cross-section wire of generally uniform wall thickness and having a reinforcing rib 1624 extending inwardly of the link 1612, beyond inner phantom demarcation surface 1625' (FIG. 16B). Rib 1624 is formed opposite the link seam 1630, such that both seam 1630 and rib 1624 lie along the minor axis 1628 of the elliptical section as seen in FIG. 16B.

Figure 16D:
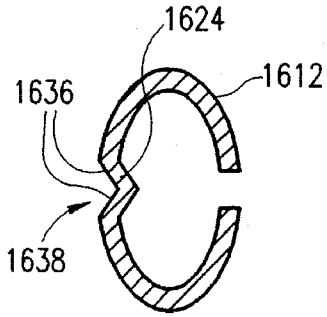
FIGS. 16C and 16D are respective perspective and sectional views of the reinforced link of FIG. 16A, after the formation thereon of high luster surfaces.
Figure 16C:
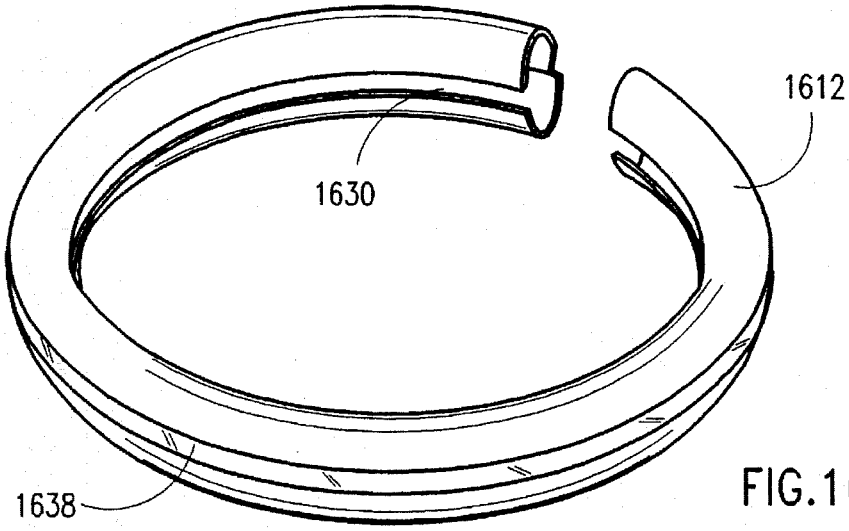

Referring now to FIGS. 16C and 16D, there are shown respective perspective and wire cross-sectional views of the reinforced link 1612 of FIG. 16A, after the formation thereon of high luster surfaces 1636, in a V-notch configuration 1638.

Figure 17A:
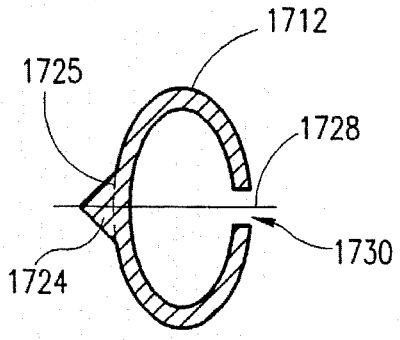
FIGS. 17A and 17B are sectional illustrations of a reinforced link similar to that of FIGS. 16A and 16B, but wherein the rib extends outwardly from the link, prior to and after formation of a high luster surface, respectively.
Figure 17B:
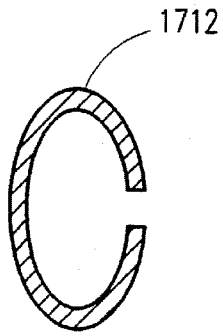

Referring now to FIGS. 17A and 17B, there are shown cross-sectional illustrations of the wire of a reinforced hollow link 1712 similar to that of FIGS. 14A and 14B, but wherein a reinforcing rib 1724 extends outwardly from the link 1712, beyond outer phantom demarcation surface 1725. The rib 1724 and seam 1730 are shown to lie along the minor axis 1728 of the elliptical section. FIG. 17A shows link 1712 wherein the rib 1724 is intact, whereas FIG. 17B shows the link 1712 after formation thereon of a high luster surface 1736.

Figure 17C:
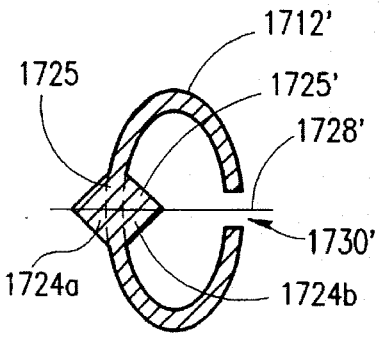
FIG. 17C is a sectional illustration of a reinforced elliptical-section link having a pair of opposing internal and external reinforcing ribs formed in alignment with the link seam, along the minor axis of the link cross-section.

FIG. 17C is an elliptical cross-sectional illustration of the wire of a link 1712' having a pair of opposing external and internal reinforcing ribs, respectively referenced 1724*a* and 1724*b*, extending beyond outer and inner phantom demarcation surfaces 1725 and 1725', formed in alignment with link seam 1730' along minor axis 1728'.

Figure 18A:
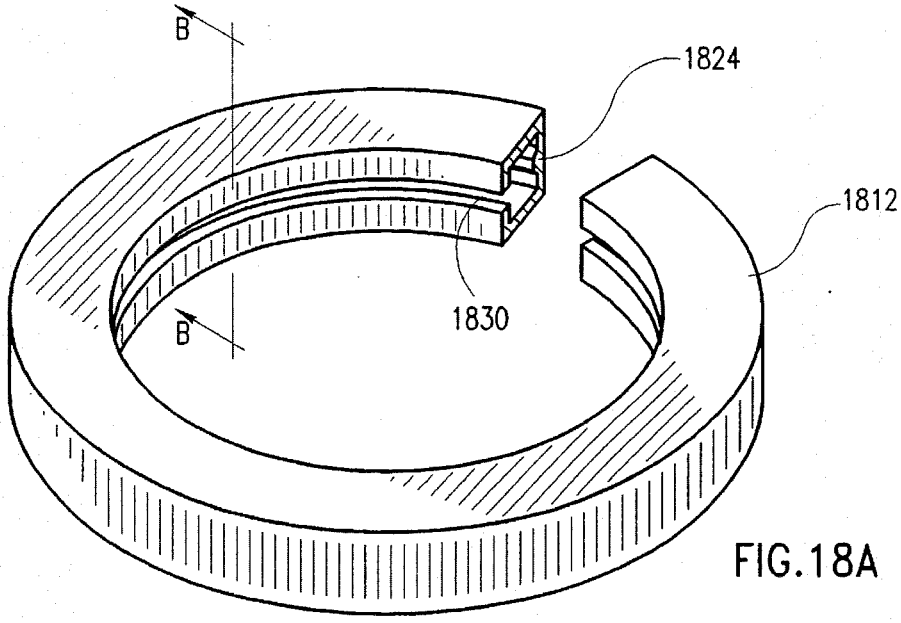
FIG. 18A is a perspective view of a reinforced square-section link having a reinforcing rib formed internally thereof, opposite the link seam.
Figure 18B:
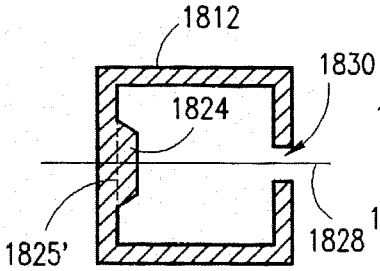
FIG. 18B is a cross-sectional view of the link of FIG. 18A, taken along line B—B therein, illustrating the rib and a seam of the link as having mutually opposite orientations.

Referring now to FIGS. 18A and 18B, there is illustrated a reinforced square wire cross-section link 1812 of generally uniform wall thickness and having a reinforcing rib 1824 extending inwardly of the link 1812, beyond inner phantom demarcation surface 1825' (FIG. 18B). Rib 1824 is formed opposite the link seam 1830, such that both seam 1830 and rib 1824 lie along a common axis 1828 of the elliptical section as seen in FIG. 18B.

Figure 18D:
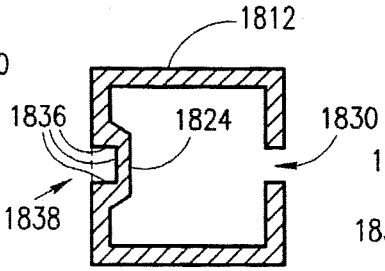
FIGS. 18C and 18D are respective perspective and sectional views of the reinforced link of FIG. 18A, after the formation thereon of high luster surfaces, in a square notch configuration.
Figure 18E:
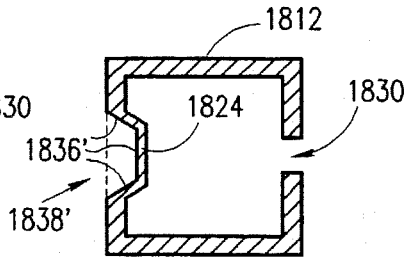
FIG. 18E is a sectional illustration of the reinforced link of FIG. 18A after the formation thereon of a high luster surface in a trapezoidal notched configuration.
Figure 18C:
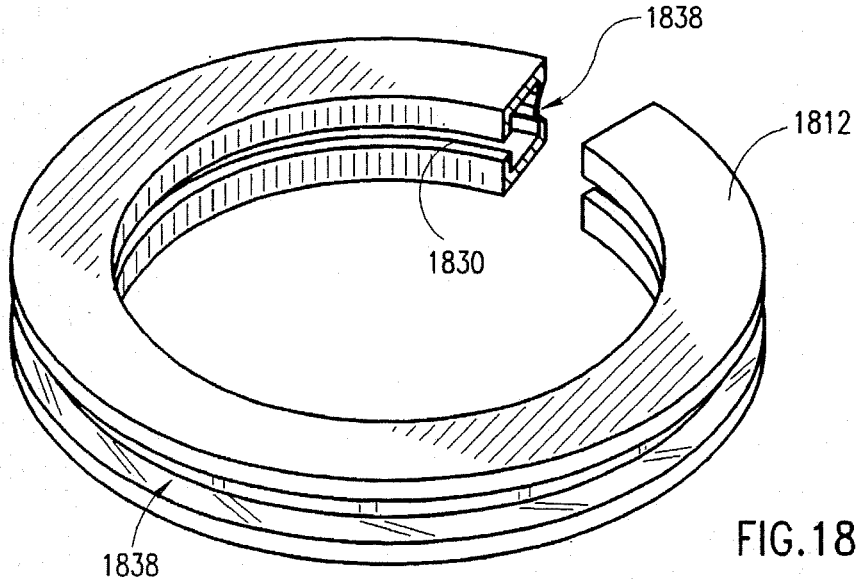

Referring now to FIGS. 18C and 18D, there are shown respective perspective and wire cross-sectional views of the reinforced link 1812 of FIG. 18A, after the formation thereon of high luster surfaces 1836, in a generally square-shaped notch configuration 1838.

FIG. 18E is a sectional illustration of the reinforced link 1812 of FIG. 18A after the formation thereon of high luster surfaces 1836' in a curved recess configuration, indicated by reference numeral 1838'.

Figure 19A:
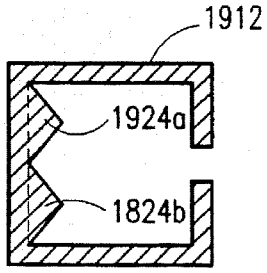
FIG. 19A is a sectional view of a reinforced square-section link having a pair of reinforcing ribs formed internally thereof, opposite the link seam.
Figure 19B:
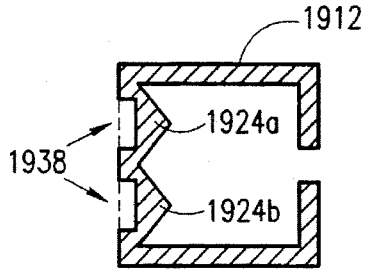
FIGS. 19B and 19C are sectional illustrations corresponding to that of FIG. 19A, but wherein a plurality of high luster surfaces have been cut into the exterior of the link in locations corresponding to those of the ribs so as to form notches of different respective configurations.
Figure 19C:
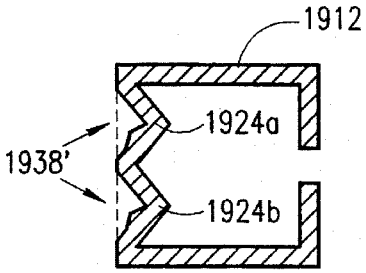

Referring now to FIGS. 19A–19C, there are shown cross-sectional illustrations of hollow wires comprising a reinforced link 1912 similar to that of FIGS. 18A–18E, but wherein a pair of inwardly extending reinforcing ribs 1924*a* and 1924*b* is provided. In FIG. 19B, a pair of rectangular-shaped notches 1938 is formed in the exterior of link 1912, in positions corresponding to the ribs 1924*a* and 1924*b*. In FIG. 19C, a pair of arrowhead-shaped notches 1938' is illustrated.

Figure 20A:
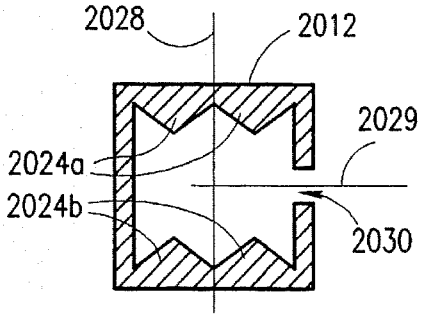
FIGS. 20A and 20B are sectional illustrations of a square-section reinforced link having two opposing pairs of reinforcing ribs formed internally thereof, transversely to the link seam, period to and after formation of notches as shown in FIG. 19B.
Figure 20B:
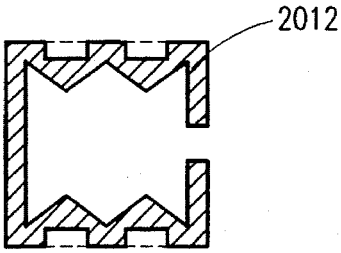
Figure 21A:
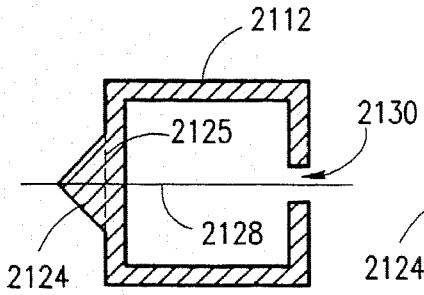
FIGS. 21A–26C are sectional illustrations of square-section reinforced links having formed thereon outwardly extending reinforcing ribs positioned opposite the seam link.
Figure 21B:
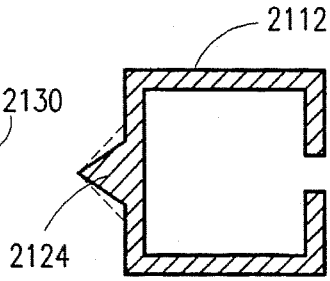
Figure 21C:
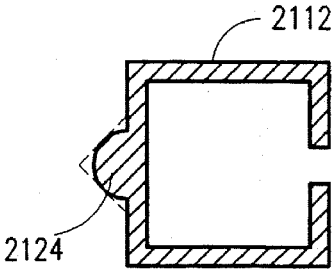
Figure 22A:
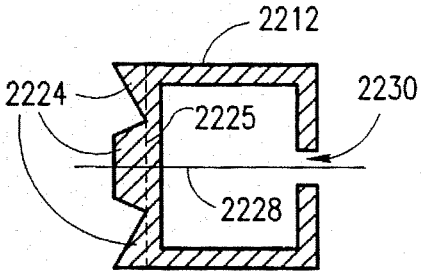
Figure 22B:
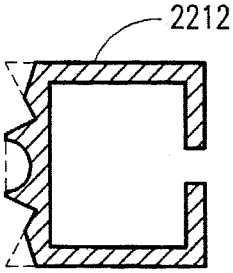
Figure 22C:
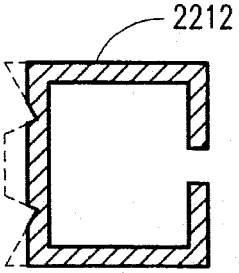
Figure 23A:
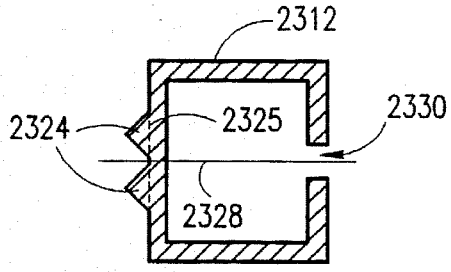
Figure 23B:
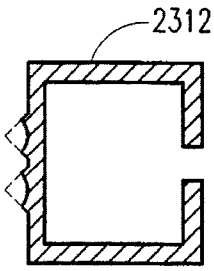
Figure 23C:
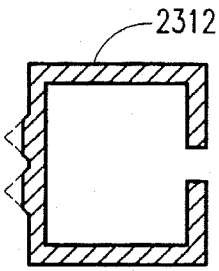
Figure 24A:
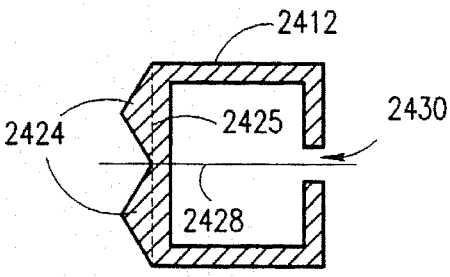
Figure 24B:
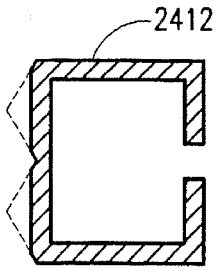
Figure 24C:
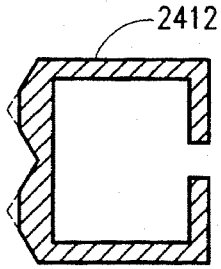
Figure 25A:
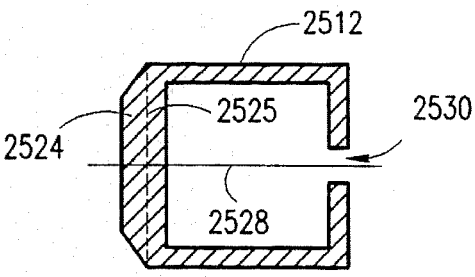
Figure 25B:
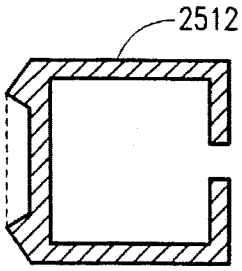
Figure 25C:
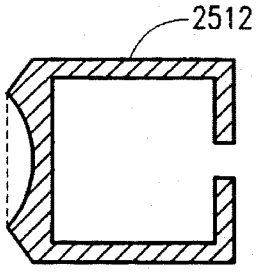
Figure 26A:
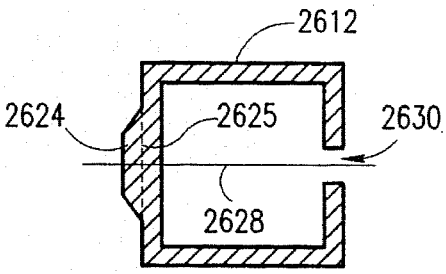
Figure 26B:
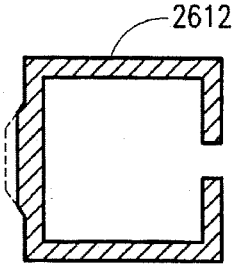
Figure 26C:
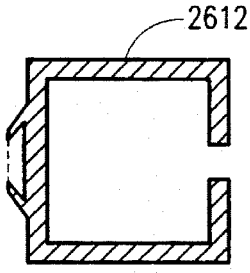

Referring briefly to FIGS. 20A and 20B, there are shown cross-sectional illustrations of hollow wires comprising reinforced link 2012 similar to that of FIGS. 18A–18D, but wherein two pairs of inwardly extending reinforcing ribs 2024*a* and 2024*b* is provided. The ribs 2024*a* and 2024*b* extend along a common axis 2028 (FIG. 20A), transverse to an axis 2029 (FIG. 20A) extending through seam link 2030. In FIG. 20B, rectangular-shaped notches 2038 are shown as having being formed in the exterior of link 2012, in positions corresponding to each of the ribs 2024*a* and 2024*b*.

Referring now to FIGS. 21A–26C, there are shown square cross-sectional illustrations of reinforced link wire, respectively referenced 2112–2612. These links are of generally uniform wall thickness and define one or more reinforcing ribs, respectively referenced 2124–2624, which extend beyond respective outward phantom demarcation surfaces 2125–2625. The reinforcing ribs, furthermore, are arranged opposite to the link seams, such that the ribs and the link seams extend along common axes. The link seams are referenced 2130–2630, respectively, and the common axes are referenced 2128–2638, respectively. Notches of various configurations are seen to have been formed in the reinforcing ribs.

Figure 27A:
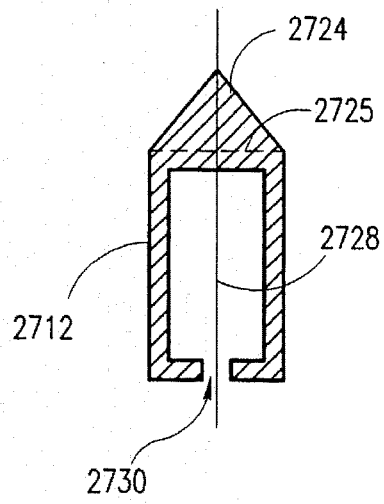
FIG. 27A is a sectional illustration of a rectangular-section reinforced link having an outwardly extending reinforcing rib formed opposite the link seam, and wherein the reinforcing rib and the seam lie along the long axis of the link section.

Reference is now made to FIG. 27A which is a cross-sectional illustration of an alternative shaped rectangular wire forming a reinforced link 2712 of generally uniform wall thickness. Link 2712 has reinforcing rib 2724 which extends outwardly, beyond a phantom demarcating surface 2725 formed opposite the link seam 2730, such that the reinforcing rib 2724 and the seam 2730 lie along the long axis 2728 of the link cross-section. Reinforcing rib 2724 may be cut as desired to provide one or more high luster surfaces (not shown).

Figure 27B:
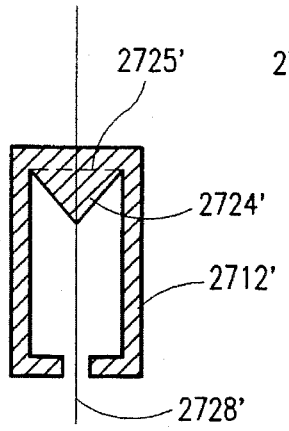
FIG. 27B is a sectional illustration of a link similar to that of FIG. 27A but wherein the reinforcing rib is inwardly extending and is formed opposite the link seam.

FIG. 27B is a sectional illustration of a link 2712' similar to that of FIG. 27A but wherein the reinforcing rib 2724' extends inwardly beyond phantom demarcating surface 2725'.

Figure 27C:
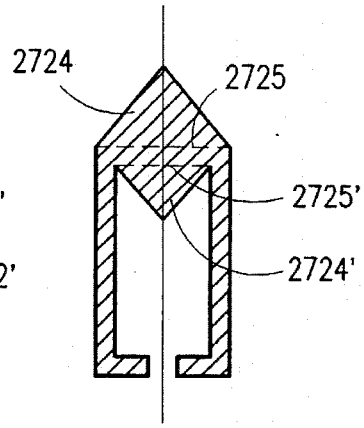
FIG. 27C is a sectional illustration of a link similar to that of FIG. 27A but having a pair of opposing internal and external reinforcing ribs.

FIG. 27C shows a combination of the links shown in FIGS. 27A and 27B, having both outwardly and inwardly extending reinforcing ribs 2724 and 2724'.

Figure 28A:
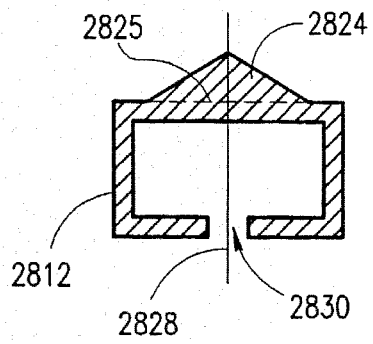
FIGS. 28A–28C are sectional illustrations of links similar to those of FIGS. 27A–27C, but wherein the reinforcing ribs and the seams lie along the short axis of the link section.

Reference is now made to FIG. 28A which is a cross-sectional illustration of a rectangular wire forming a reinforced link 2812 of generally uniform wall thickness. Link 2812 has reinforcing rib 2824 which extends outwardly, beyond a phantom demarcating surface 2825 formed opposite to the link seam 2830, such that the reinforcing rib 2824 and the seam 2830 lie along the short axis 2828 of the link cross- section. Reinforcing rib 2824 may be cut as desired to provide one or more high luster surfaces (not shown).

Figure 28B:
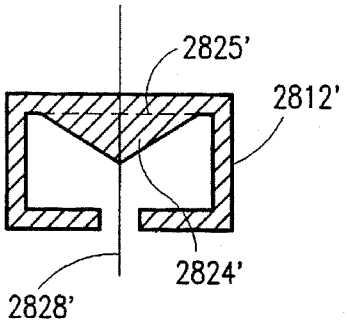

FIG. 28B is a sectional illustration of a link 2812' similar to that of FIG. 28A but wherein the reinforcing rib 2824' extends inwardly beyond phantom demarcating surface 2825'.

Figure 28C:
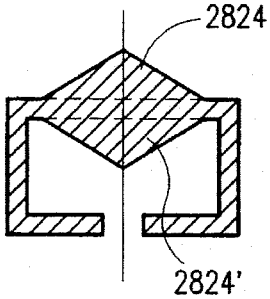

FIG. 28C shows a combination of the links shown in FIGS. 28A and 28B, having both outwardly and inwardly extending reinforcing ribs 2824 and 2824'.

Figure 29A:
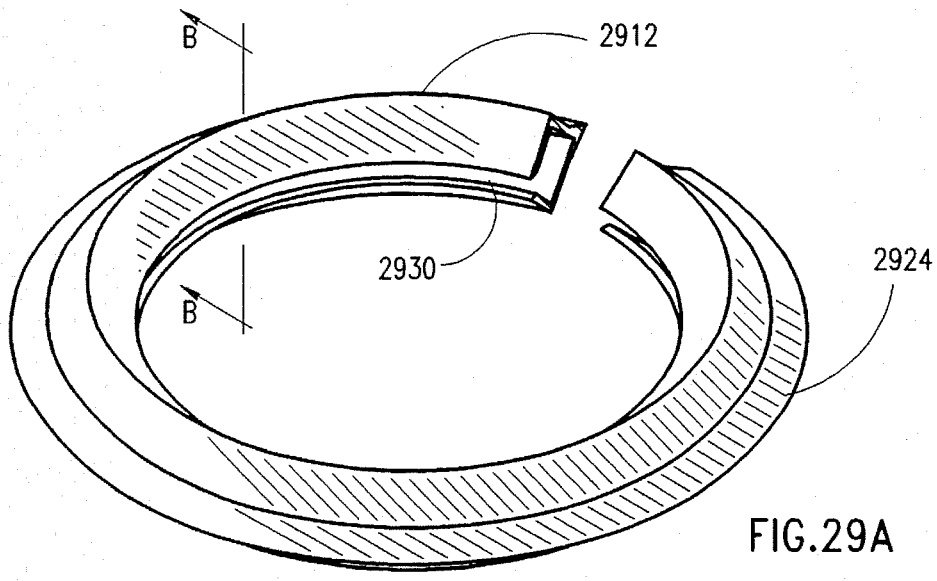
FIG. 29A is a perspective view of a reinforced diamond-section link having a reinforcing rib formed externally thereof, opposite the link seam.
Figure 29B:
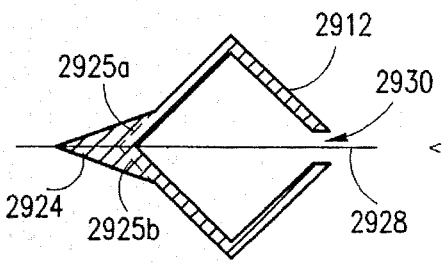
FIG. 29B is a cross-sectional view of the link of FIG. 29A, taken along line B—B therein, illustrating the rib and a seam of the link as having mutually opposite orientations.

Referring now to FIGS. 29A and 29B, there is illustrated a link 2912 having a reinforced diamond-shaped cross-section of generally uniform wall thickness and having a reinforcing rib 2924 extending outwardly of the link 2912, beyond phantom demarcation surfaces 2925*a* and 2925*b* (FIG. 29B). Rib 2924 is formed opposite the link seam 2930, such that both seam 2930 and rib 2924 lie along a common axis 2928 as seen in FIG. 29B.

Figure 29D:
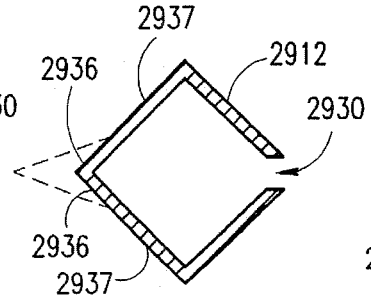
FIGS. 29C and 29D are respective perspective and sectional views of the reinforced link of FIG. 29A, after the formation thereon of high luster surfaces.
Figure 29E:
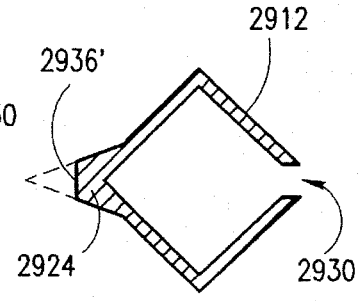
FIG. 29E is a sectional illustration of the reinforced link of FIG. 29A after the formation thereon of a high luster surface in accordance with a further embodiment of the invention.
Figure 29C:
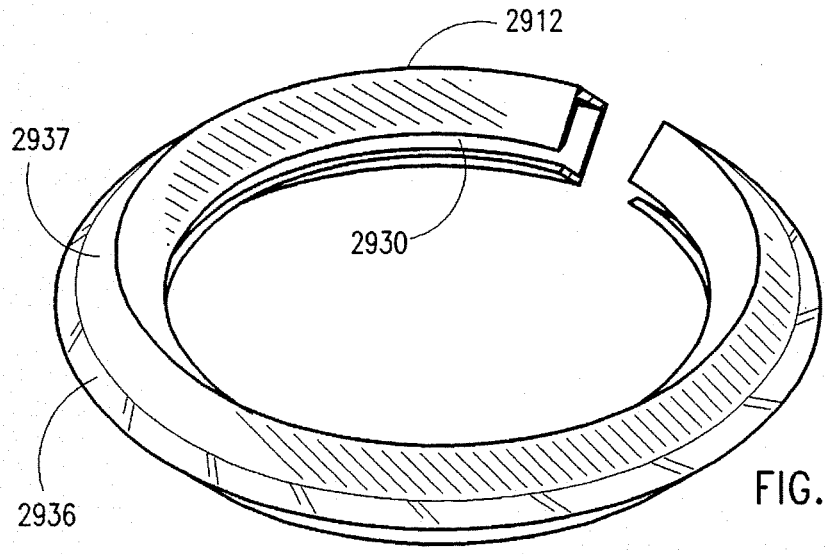

Referring now to FIGS. 29C and 29D, there are shown respective perspective and wire cross-sectional views of the reinforced link 2912 of FIG. 29A, after the formation thereon of high luster surfaces 2936, substantially flush with adjacent exterior surfaces 2937 of the link.

FIG. 29E is a wire cross-sectional illustration of the reinforced link 2912 of FIG. 29A after the formation thereon of a high luster surface 2936' so as to impart a truncated configuration to rib 2924.

Figure 30A:
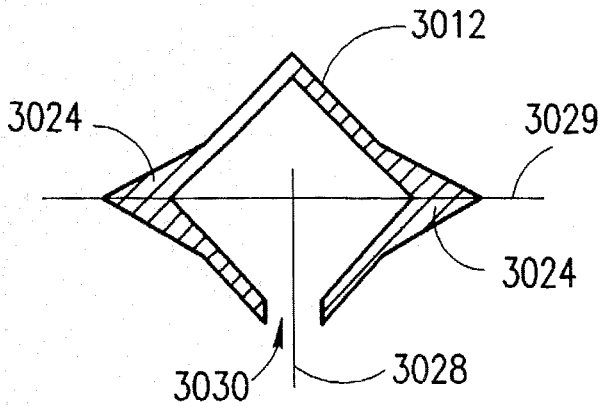
FIGS. 30A and 30B are sectional views of a link similar to those shown in FIGS. 29B and 29D, but wherein a pair of opposing reinforcing ribs is provided along an axis transverse to the link seam.
Figure 30B:
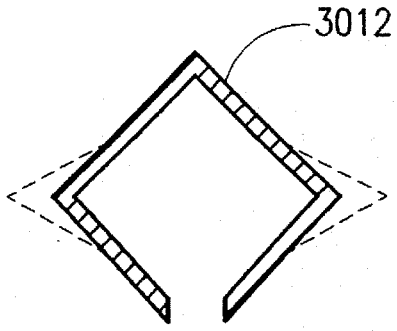

Reference is now made to FIGS. 30A and 30B in which are illustrated wire cross-sectional views of a link 3012 similar to that of FIGS. 29A–29E, but wherein a pair of opposing reinforcing ribs 3024 (FIG. 30A) is provided along an axis 3029 transverse to an axis 3028 along which the link seam 3030 extends.

Not only the wire cross-section can have any shape as discussed above, but also the chain links may have different shapes. Generally, however, the links in a particular chain have the same shape. Thus it is possible to make chains, especially rope chains, from links that are round, oval, barrel shaped, triangular, square, rectangular, diamond shaped, hexagonal, octagonal or other polygonal shape, symmetrical, non-symmetrical, elongated or circular.

It will be appreciated by persons skilled in the art that the scope of the present invention is not limited by what has been shown and described above, merely by way of example, and that reinforcing ribs in accordance with the present invention, and high luster surfaces thereon, may be provided in various configurations not shown and described hereinabove. The scope of the present invention is limited, rather, solely by the claims which follow.

I claim:

1. A fine jewelry hollow rope chain comprising a plurality of interfitting hollow wire links, each link defining a circumference, each link having a wire cross-section defining a hollow base portion of generally uniform wall thickness and at least one reinforcing rib portion joined on said base portion, said rib portion protruding beyond said base portion along the entire circumference of said link, thereby reinforcing said hollow link against mechanical deformation.

2. A fine jewelry rope chain according to claim 1, and wherein said at least one rib is demarcated from said base portion by a phantom demarcating surface.

3. A fine jewelry rope chain according to claim 1, and wherein said at least one rib is located so as to reinforce said hollow wire link with respect to a force applied transversely to said rib portion.

4. A fine jewelry rope chain according to claim 1, and wherein said hollow wire link is a seamed link, and said seam and said rib portion lie along a common axis.

5. A fine jewelry rope chain according to claim 1, and wherein said hollow link is a seamed link, and said seam and said rib portion lie along mutually transverse axes.

6. A fine jewelry rope chain according to claim 1, and wherein each said hollow link defines an interior surface and an exterior surface parallel thereto, and said at least one rib lies along said interior surface so as to protrude into the hollow interior of said link.

7. A fine jewelry rope chain according to claim 1, and wherein each said hollow link defines an interior surface and an exterior surface parallel thereto, and said at least one rib lies along said exterior surface so as to protrude outwardly from said link.

8. A fine jewelry rope chain according to claim 1, and wherein each said hollow link defines an interior surface and an exterior surface parallel thereto, and said at least one rib comprises at least a first rib formed along said interior surface so as to protrude into the interior of said link and a second rib formed along said exterior surface so as to protrude outwardly from said link.

9. A fine jewelry rope chain according to claim 1, and wherein each said link has a wire cross-sectional configuration selected from the group comprising:

round, oval, barrel shaped, triangular, square, rectangular, diamond shaped, hexagonal, octagonal, symmetrical, elongated and irregular.

10. A fine jewelry rope chain according to claim 1, and wherein each said link has a configuration selected from the group comprising:

round, oval, barrel shaped, triangular, square, rectangular, diamond shaped, hexagonal, octagonal, symmetrical, elongated and irregular.

11. A fine jewelry rope chain according to claim 1, and wherein at least one of said hollow links has one or more high luster surfaces formed on said rib portion.

12. A fine jewelry rope chain according to claim 11, and wherein each said hollow link defines an interior surface and an exterior surface parallel thereto, and said at least one rib lies along said interior surface so as to protrude into the hollow interior of said link, and wherein said at least one high luster surface is formed on a portion of said exterior surface of said link corresponding to the location of said at least one rib.

13. A fine jewelry rope chain according to claim 11, and wherein each said hollow link defines an interior surface and an exterior surface parallel thereto, and said at least one rib lies along said exterior surface so as to protrude outwardly from said link, and wherein said at least one high luster surface is formed on said at least one rib.

14. For use in a fine jewelry rope chain, a reinforced hollow link formed from a link wire, and wherein the wire cross-section of said link has a base portion of generally uniform wall thickness, and has formed along a surface thereof at least one reinforcing rib portion which protrudes beyond said base portion, thereby reinforcing said link against mechanical deformation.

15. A reinforced hollow link according to claim 14, and wherein said at least one rib is demarcated from said base portion by a phantom demarcating surface.

16. A reinforced hollow link according to claim 14, and wherein said at least one rib is located so as to reinforce said hollow wire link with respect to a force applied transversely to said rib portion.

17. A reinforced hollow link according to claim 14, and wherein said hollow wire link is a seamed link, and said seam and said rib portion lie along a common axis.

18. A reinforced hollow link according to claim 14, and wherein said hollow link is a seamed link, and said seam and said rib portion lie along mutually transverse axes.

19. A reinforced hollow link according to claim 14, and wherein each said hollow link defines an interior surface and an exterior surface parallel thereto, and said at least one rib lies along said interior surface so as to protrude into the hollow interior of said link.

20. A reinforced hollow link according to claim 14, and wherein each said hollow link defines an interior surface and an exterior surface parallel thereto, and said at least one rib lies along said exterior surface so as to protrude outwardly from said link.

21. A reinforced hollow link according to claim 14, and wherein each said hollow link defines an interior surface and an exterior surface parallel thereto, and said at least one rib comprises at least a first rib formed along said interior surface so as to protrude into the interior of said link and a second rib formed along said exterior surface so as to protrude outwardly from said link.

22. A reinforced hollow link according to claim 14, having a wire cross-sectional configuration selected from the group which comprises:

round, oval, barrel shaped, triangular, square, rectangular, diamond shaped, hexagonal, octagonal, symmetrical, elongated and irregular.

23. A reinforced hollow link according to claim 14, having a configuration selected from the group comprising:

round, oval, barrel shaped, triangular, square, rectangular, diamond shaped, hexagonal, octagonal, symmetrical, elongated and irregular.

24. A reinforced hollow link according to claim 14, having at least one high luster surface formed on said rib portion.

25. A reinforced hollow link according to claim 24, defining an interior surface and an exterior surface parallel thereto, and said at least one rib lies along said interior surface so as to protrude into the hollow interior of said link, and wherein said at least one high luster surface is formed on a portion of said exterior surface of said link corresponding to the location of said rib.

26. A reinforced hollow link according to claim 24, defining an interior surface and an exterior surface parallel thereto, and said at least one rib lies along said exterior surface so as to protrude outwardly from said link, and wherein said at least one high luster surface is formed on said at least one rib.

27. A method of manufacturing a fine jewelry rope chain comprising the following steps:

first, forming a length of metal foil having a base portion of generally uniform thickness and further having on the base portion thereof at least one or more reinforcing ribs;

second, forming the length of metal foil into a hollow wire having at least one reinforcing rib along its length;

third, forming the hollow wire into chain links, each having a gap slightly larger than the outer diameter of the link wire, so that one link can be fitted into another via the gap; and assembling the plurality of reinforced links into a reinforced rope chain.

28. A method according to claim 27, and wherein said first step of forming comprises forming the rib on the base portion such that the rib portion is positioned so as to reinforce the hollow wire link with respect to a force applied transversely to the rib portion.

29. A method according to claim 27, and wherein said second step of forming comprises the step of forming a seamed hollow wire and said third step of forming comprises the step of forming a seamed wire chain link, and wherein said first step of forming comprises the step of forming the rib on the base portion such that the seam and the rib portion lie along a common axis.

30. A method according to claim 27, and wherein said second step of forming comprises the step of forming a seamed hollow wire and said third step of forming comprises the step of forming a seamed wire chain link, and wherein said first step of forming comprises the step of forming the rib on the base portion such that the seam and the rib portion lie along mutually transverse axes.

31. A method according to claim 27, and wherein said second step of forming comprises the step of folding the metal foil about the rib such that it protrudes inwardly into the hollow wire.

32. A method according to claim 27, and wherein said second step of forming comprises the step of folding the metal foil longitudinally such that the rib protrudes outwardly with respect to the hollow wire.

33. A method according to claim 27, and wherein said first step of forming comprises forming at least a pair of ribs on opposite sides of the base portion, and said second step of forming comprises the step of folding the link wire longitudinally such that one rib protrudes outwardly with respect to the hollow wire and one rib protrudes inwardly thereof.

34. A method according to claim 27, and wherein said second step of forming comprises forming a hollow wire with a symmetrical cross-sectional configuration.

35. A method according to claim 27, and also including the step of providing at least one high luster surface on said at least one rib.

36. A method according to claim 35, and wherein each hollow link has an interior surface and an exterior surface parallel thereto, said second step of forming comprises the step of folding the link wire about the rib such that it protrudes inwardly into the hollow wire, and said step of providing at least one high luster surface comprises the step of providing the at least one high luster surface on a portion of the exterior surface of the link corresponding to the location of the rib.

37. A method according to claim 35, and wherein said second step of forming comprises the step of folding the metal foil longitudinally such that the rib protrudes outwardly with respect to the wire, and wherein said step of providing at least one high luster surface comprises the step of providing the at least one high luster surface on the rib.

* * * * *